US005962205A

United States Patent [19]

Arakawa et al.

[11] Patent Number: 5,962,205

[45] Date of Patent: Oct. 5, 1999

[54] SILVER HALIDE COLOR PHOTOGRAPHIC LIGHT-SENSITIVE MATERIAL AND METHOD AND APPARATUS FOR FORMING IMAGES USING THE SAME

[75] Inventors: Jun Arakawa, Minami-Ashigara; Tooru Matama, Kaiseimachi, both of Japan

[73] Assignee: Fuji Photo Film Co., Ltd., Kanagawa, Japan

[21] Appl. No.: 08/946,582

[22] Filed: Oct. 7, 1997

[30] Foreign Application Priority Data

Oct. 7, 1996 [JP] Japan ..... 8-282918

[51] Int. Cl.[6] ..... G03C 1/72

[52] U.S. Cl. ..... 430/503; 430/543; 430/549

[58] Field of Search ..... 430/503, 505, 430/506, 543, 549

[56] References Cited

U.S. PATENT DOCUMENTS 4,830,954 5/1989 Matejec ..... 430/505

5,382,506 1/1995 Tosaka et al. ..... 430/505

FOREIGN PATENT DOCUMENTS 1458370 12/1976 United Kingdom .

*Primary Examiner*—Hoa Van Le

*Attorney, Agent, or Firm*—Birch, Stewart, Kolasch & Birch, LLP

[57] ABSTRACT

The present invention provides a silver halide color photographic light-sensitive material which has a high sensitivity and a high image quality, and a method and apparatus for forming an image by use of the light-sensitive material. The light-sensitive material comprises a support having provided thereon three light-sensitive units each having a different color-sensitivity, wherein one of the light-sensitive units is a white-sensitive unit having a spectral sensitivity distribution satisfying the following conditions. The method and apparatus for forming images using the material, in which the material is imagewise-exposed and subject to processing, thereby forming an image, the image is read out by an image pick-up means, then subjected to digital image processing, and three or more color output signals are obtained.

$0.05 \leqq S_{450}/S_{550} \leqq 1.2$ and $0.05 \leqq S_{600}/S_{550} \leqq 1.2$ wherein $S_{450}$, $S_{550}$ and $S_{600}$ represent sensitivities at 450 nm, 550 nm and 600 nm, respectively.

12 Claims, 4 Drawing Sheets

SILVER HALIDE COLOR PHOTOGRAPHIC LIGHT-SENSITIVE MATERIAL AND METHOD AND APPARATUS FOR FORMING IMAGES USING THE SAME

BACKGROUND OF THE INVENTION

The present invention relates to a system for reading out three or more image recording signals from a silver halide color photographic light-sensitive material after being imagewise-exposed and subjected to processing, and processing the signals to obtain image output signals.

The most generally adopted system of the conventional color photography consists in combining a color negative film and a color print material. The color negative film in the above-mentioned system is produced by mixing three primary colors of the subtractive process with three silver halide emulsions having each a different spectral sensitivity, respectively and forming a multilayered construction of these emulsions on a support.

That is, the layered construction is composed of a unit which is sensitized by a blue component to produce a yellow dye image, a unit which is sensitized by a green component to produce a magenta dye image and a unit which is sensitized by a red component to produce a cyan dye image. In each of the constituent layers, the dye image is formed by the reaction between a developing agent, which is oxidized in the processing where the latent image forming silver halide grains are reduced to silver, and a dye precursor (a dye forming coupler). The undeveloped silver halide is removed at the fixing step, while the undesirable developed silver image is removed at the bleaching step and the fixing step that follows. A positive color print is obtained by giving an exposure to a color paper through the color negative film bearing the color image and thereafter processing the exposed paper in a manner designed for the color paper.

Recently, because of the remarkable trend of compaction of cameras, insufficiency in the sensitivity is addressed as an emerging problem of a color photographic material due to the downsizing of the built in stroboscope. In addition, since the enhancement in image quality is also important as the format is made smaller, there is a strong demand for a color photographic material which has a high sensitivity and a high image quality.

In the case of a conventional color photographic material including a color negative film, the photo-sensitive unit generally consists of three units, namely a blue-sensitive unit, a green-sensitive unit and a red-sensitive unit. Despite many continuous efforts for the enhancement in sensitivity and image quality by use of the above-mentioned construction, the objective has not been sufficiently achieved in the face of the above-mentioned small-sized stroboscope and format.

JP-A-63-95441 ("JP-A" means Published Unexamined Japanese Patent Application) discloses a method wherein a fourth light-sensitive layer, which is sensitized by white light to produce black, is formed in a position farthest from the support in addition to the conventionally adopted blue-sensitive unit, green-sensitive unit and red-sensitive unit.

By the above-described arrangement in which the white-sensitive layer has the highest sensitivity, indeed the apparent sensitivity is increased, but in practical use the high sensitivity is known to be associated with disadvantages that the sensitivity of the underlying layers drops remarkably and that any attempt to make up for the drop in the sensitivity, for example, by increasing the size of the silver halide grains increases significantly the load on the image quality and degrades the image. Other disadvantages are that, because of remarkable decrease in chroma, the above-mentioned array cannot be realized by use of a conventional printing system. Further, since the construction includes an extra layer in addition to conventional layers having spectral sensitivities, the amount of silver and the thickness of the coating naturally increase, which undesirably contradicts the recent trend for rapid processing and reduction in the quantity of replenisher.

In the case of a conventional color photographic material including a color negative film, the generally adopted arrangement of the light-sensitive units is such that a blue-sensitive unit, a green-sensitive unit and a red-sensitive unit are formed in that order from the far side of the support. This is because the light for sensitizing the material is effectively used in this arrangement and therefore this arrangement is advantageous from the viewpoint of the enhancement in sensitivity. However, it is obvious that the disadvantage of such a multilayered construction emerges in the layer nearest to the support. That is, although the blue-sensitive unit, which has thereon no coloring layer or light-scattering layer, can exhibit a high sensitivity, the green-sensitive unit, which is affected by the absorption and scattering of light by the blue-sensitive unit, suffers from the loss in sensitivity and sharpness. Likewise, the red-sensitive unit suffers from the loss due to the absorption and scattering of light by the blue-sensitive unit and the green-sensitive unit. Further, since the processing of the lower layer, namely the layer nearer to the support, is delayed, this delay undesirably causes loss in sensitivity and gradation of the lower layer.

In order to reduce the above-described load, a method has been contemplated whereby the most important layer, namely a green-sensitive unit, which has the largest contribution to the visual sensitivity, is formed in the uppermost position, i.e., the position farthest from the support. This method, however, has the problem that the sensitivity of the blue-sensitive unit, which is nearer to the support, is further remarkably decreased and the muddiness of color is excessive.

As stated above, in the case of a conventional color photographic material, which comprises a blue-sensitive unit, a green-sensitive unit and a red-sensitive unit, any attempt to increase the sensitivity of the light-sensitive unit and to improve the image quality is faced with a serious constraint, which makes it impossible to improve drastically the sensitivity and the image quality.

BRIEF SUMMARY OF THE INVENTION

Accordingly, it is therefore an object of the present invention to provide a silver halide color-photographic light-sensitive material which has a high sensitivity and a high image quality, a method and apparatus for forming images by use of the light-sensitive material.

The above object of the present invention can be achieved by the following means.

(1) A silver halide color photographic light-sensitive material comprising a support having provided thereon three light-sensitive units each having a different color-sensitivity, wherein one of the light-sensitive units is a white-sensitive unit having a spectral distribution satisfying the following conditions:

$0.05 \leqq S_{450}/S_{550} \leqq 1.2$ and $0.05 \leqq S_{600}/S_{550} \leqq 1.2$ wherein $S_{450}$, $S_{550}$ and $S_{600}$ represent sensitivities at 450 nm, 550 nm and 600 nm, respectively.

(2) The silver halide color photographic light-sensitive material according to item (1), wherein the light-sensitive units other than the white-sensitive unit are two light-sensitive units selected from the group consisting of a blue-sensitive unit, a green-sensitive unit and a red-sensitive unit having the following wavelengths for maximum spectral sensitivity, respectively:

$410 \leqq \lambda$ Bmax $\leqq 490$ nm $510 \leqq \lambda$ Gmax $\leqq 590$ nm $580 \leqq \lambda$ Rmax $\leqq 660$ nm wherein $\lambda$ Bmax, $\lambda$ Gmax and $\lambda$ Rmax represent the wavelengths for maximum spectral sensitivity of the blue-sensitive unit, the green-sensitive unit and the red-sensitive unit, respectively.

(3) The silver halide color photographic light-sensitive material according to item (1) or (2), wherein at least one layer of the white-sensitive unit is formed in a position farthest from the support among all of the light-sensitive silver halide emulsion layers.

(4) The silver halide color photographic light-sensitive material according to any of items (1) to (3), wherein a non light-sensitive intermediate layer containing substantially non light-sensitive silver halide grains is formed in a position adjacent to the high-speed white-sensitive layer and/or the high-speed light-sensitive layer of the light-sensitive units other than the white-sensitive unit on the side of these layers facing toward the support.

(5) A method for forming images using the silver halide color photographic light-sensitive material according to any of items (1) to (4), in which the material is imagewise-exposed and subjected to processing, thereby forming an image, the image is read out by an image pick-up means, then subjected to digital image processing, and three or more color output signals are obtained.

(6) An apparatus for forming images using the silver halide color photographic light-sensitive material according to any of item (1) to (4), in which the material is imagewise-exposed and subjected to processing, thereby forming an image, the image is read out by an image pick-up means, then subjected to digital image processing, and three or more color output signals are obtained.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
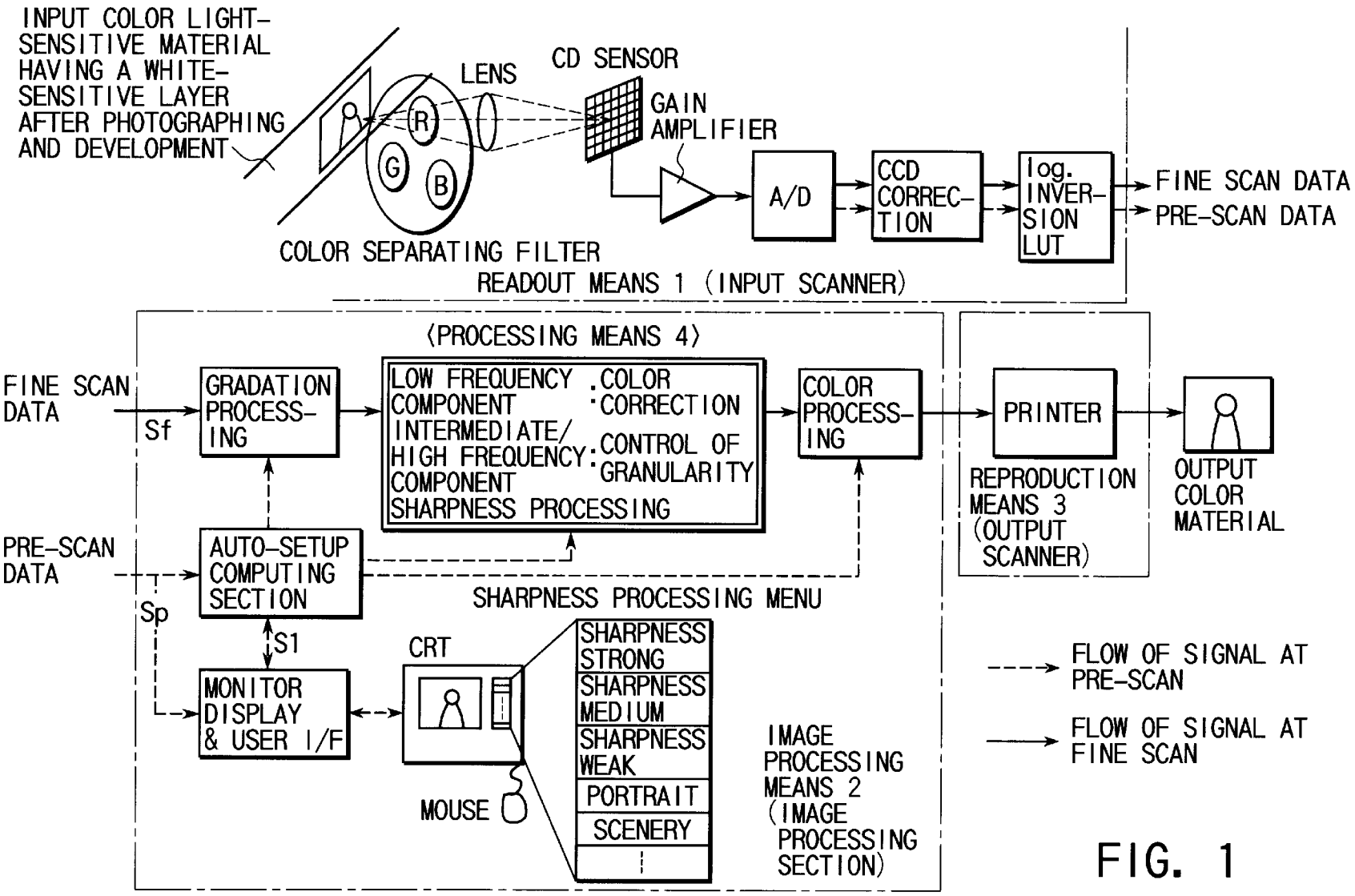
FIG. 1 is a block diagram illustrating a digital photographic printer system including the image processing section as an embodiment of the present invention.

The present invention will be described in more detail below.

Among the three light-sensitive units of a silver halide color photographic light-sensitive material to be used in the present invention, one of the light-sensitive unit is a white-sensitive unit specified by the following spectral sensitivity distribution:

$0.05 \leqq S_{450}/S_{550} \leqq 1.2$ and $0.05 \leqq S_{600}/S_{550} \leqq 1.2$ wherein $S_{450}$, $S_{550}$ and $S_{600}$ represent sensitivities at 450 nm, 550 nm and 600 nm, respectively.

Preferably, the spectral sensitivity distribution of the white-sensitive unit falls within the following range:

$0.2 \leqq S_{450}/S_{550} \leqq 1.0$ and $0.2 \leqq S_{600}/S_{550} \leqq 1.0$.

Since the white-sensitive unit is required to be sensitive to the three primary colors of blue, green and red at the same time, this requirement is expressed in the above relationship of spectral sensitivity distribution.

If both $S_{450}/S_{550}$ and $S_{600}/S_{550}$ are 0.05 or less, the light-sensitive unit is substantially a green-sensitive unit. If $S_{450}/S_{550}$ is 0.05 or less, the light-sensitive unit is a yellow-sensitive unit. If $S_{600}/S_{550}$ is 0.05 or less, the light-sensitive unit is a cyan-sensitive unit. Consequently, the high-sensitivity intended in the present invention cannot be achieved.

Meanwhile, if $S_{450}/S_{550}$ or $S_{600}/S_{550}$ is 1.2 or more, the sensitivity of the light-sensitive units other than the white-sensitive unit, particularly the sensitivity of blue-sensitive unit and red-sensitive unit, remarkably decreases and, as a result, the sensitivity of the light-sensitive material as a whole decreases. In addition, it has become evident that the color impurity that emerges requires a larger color correction factor in the digitization, which aggravates the graininess of the final images.

The spectral sensitivity distributions of the two light-sensitive units other than the white-sensitive unit can be selected at will from within a visible region, but a preferable correlation is that the selected three spectral sensitivity distributions, i.e., the spectral sensitivity distribution of the white-sensitive unit and the spectral sensitivity distributions of other two light-sensitive units, each give 0.7 or more of the value for colorimetric quality factor. The method for determining the calorimetric quality factor (q factor) is described in "The Theory of the Photographic Process" by T. H. James, Macmillan, 1977, 4th edition, page 567.

Further, it is preferable that the wavelengths for the maximum spectral sensitivities of the two light-sensitive units other than white-sensitive unit are selected from the following $\lambda$ Bmax, $\lambda$ Gmax and $\lambda$ Rmax:

410 nm $\leqq \lambda$ Bmax $\leqq 490$ nm 510 nm $\leqq \lambda$ Gmax $\leqq 590$ nm 580 nm $\leqq \lambda$ Rmax $\leqq 660$ nm.

The two light-sensitive units other than white-sensitive unit are selected from a blue-sensitive unit, a green-sensitive unit and a red-sensitive unit, whose spectral sensitivity distributions are shown above. If the wavelength for the maximum spectral sensitivity of the blue-sensitive unit λ Bmax is 410 nm or less, a sufficient sensitivity cannot be obtained, whereas if λ Bmax is 490 nm or more, a larger color correction factor due to increase in the color impurity aggravates the graininess. In the case of the green-sensitive unit, λ Gmax, which is 510 nm or less, or otherwise 590 nm or more, aggravates the graininess because of the larger color correction factor required due to color impurity. In the case of the red-sensitive unit, λ Rmax, which is 580 nm or less, aggravates the graininess because of the larger color correction factor required due to color impurity, whereas λ Rmax, which is 660 nm or more, causes a serious problem that the color of an object, which reflects the wavelengths in near-infrared region imperceptible to human eyes, changes singularly.

The white-sensitive unit may be coated in any position of the multilayered silver halide color photographic light-sensitive material, but it is preferable that the layer having the highest sensitivity in particular of the white-sensitive unit be coated in the position farthest from the support among all of the light-sensitive layers in order to obtain a better sensitivity and image quality.

Although the white-sensitive unit and other two light-sensitive units may each consist of one layer, each of these units preferably consists of two or more light-sensitive layers each having a different sensitivity. More preferably, one or more of the light-sensitive units consist of three or more light-sensitive layers. If every light-sensitive unit consist of two or more light-sensitive layers each having a different sensitivity, the order of the layer formation from the position farthest from the support according to a preferred embodiment is a white-sensitive unit having the highest sensitivity, a second color-sensitive layer having the highest sensitivity, a third color-sensitive layer having the highest sensitivity, a white-sensitive unit having the second highest sensitivity, a second color-sensitive layer having the second highest sensitivity and a third color-sensitive layer having the second highest sensitivity. In this case, it is preferable that a non light-sensitive intermediate layer be present between these silver halide emulsion layers.

As illustrated in the above-described preferred embodiment, the plural light-sensitive layers constituting a light-sensitive unit may be adjacent to each other, or these layers may sandwich between them a light-sensitive layer belonging to other light-sensitive unit. The plural light-sensitive layers belonging to the same light-sensitive unit have the wavelengths for the maximum sensitivity in the spectral sensitivity distribution correlated in such a manner that the difference between the wavelengths for the maximum sensitivity is not more than 30 nm. Therefore, these plural layers are sensitive to substantially the same color and these plural layers produce substantially the same hue as a result of development.

A non light-sensitive layer is preferably formed and it is a so-called light-reflecting layer which reflects the light and which adjoins, on the side facing toward the support, particularly the white-sensitive layer having the highest sensitivity and/or a second light-sensitive layer having the highest sensitivity and/or a third light-sensitive layer having the highest sensitivity. Preferably, the light-reflecting material to be used in the light-reflecting layer is fine silver halide grains. The most preferable light-reflecting material is tabular silver halide grains having an aspect ratio of 3 or more.

Although the silver halide color photographic light-sensitive material according to the present invention can be used in a conventional process, which comprises photographing, development and thereafter printing on a color print material by an enlarger or an automatic printer, to produce a final image output, a particularly preferred process comprises producing an image using the light-sensitive material by a conventional method, reading out the image by an image pick-up means, digitizing the image to obtain three or more color output signals and feeding the output signal to a light-sensitive material constituting output.

The image pick-up means use a photoelectric sensing element as a sensor, preferably a CCD array. The most preferred CCD array is an area-type CCD sensor.

As described in JP-A-7-15593, an area-type CCD sensor usually comprises a combination of 500 or more charge coupled devices (CCD) sensor and is very suitable for use in the present invention because of high resolving power and capability of reading out image information rapidly. The area-type CCD sensor, which is shown in FIG. 1 for the purpose of illustrating the present invention, has a photodetector comprising 920 pixels long and 1380 pixels broad and has a very high resolving power.

As illustrated in FIG. 1, the image pick-up means preferably includes an A/D conversion means which performs the A/D conversion of the signals representative of the color image signals detected by the CCD array, a correction means which corrects the CCD array, and a conversion means which converts the image signals into logarithmic values.

The image pick-up means preferably has a construction wherein pre-scanning is conducted for obtaining the outline information of a film image by means of reading scan beams having a larger spacing and fine-scanning is then conducted for reading out the film image by a higher resolving power.

It is preferable to have an image processing section for the image data after being pre-scanned and fine-scanned as illustrated above. Preferably, the image processing includes alteration in gradation, control of granularity, emphasis of sharpness, color correction, dodging processing and the like. Further, it is preferable to display instantly the results of the image processing for monitor in order to provide better convenience to users.

Although various output means can be used for obtaining a color image from the image-processed image data, a preferred image output device is a device which feeds the image data output onto a color paper by use of laser light. A particularly preferred image output device is based on a dry system substantially free of processing liquids, and examples of such devices include PICTROGRAPHY 3000 manufactured by Fuji Film Co., Ltd.

The image processing section and the steps preceding or following the image processing section are described below.

The system comprising an image processing device according to the present invention includes a readout means 1 (input scanner) which reads out the image from a color photograph, an image processing means 2 (image processing section) which processes the image signals representative of the image of the color photograph fed from the readout means 1, and a reproduction means 3 (output scanner) which records on a recording material as a visible image the image signals processed by the image processing means 2. FIG. 1 shows a block diagram of an example of a digital photograph printer system comprising the above-described image processing section.

The above-mentioned example is further explained below, but the present invention is not limited to this example.

The readout means 1 reads photoelectrically, by using R, G and B color-separating filters respectively, a color image obtained by photographing and subsequent processing by use of a photographic color negative light-sensitive material according to the present invention, which comprises a white-sensitive unit and other two light-sensitive units, to produce image signals corresponding to the three units.

In this embodiment, the relationship between the spectral sensitivity and color formation is as follows for the white-sensitive unit and other two light-sensitive units: the white-sensitive unit: magenta color formation; blue-sensitive unit: yellow color formation; and red-sensitive unit: cyan color formation.

The relationship between the color separating filters for reading out and the obtained image signals are as follows: red separation: image signal R (signal corresponding to red-sensitive unit); green separation: image signal W (signal corresponding to white-sensitive unit); and blue separation: image signal B (signal corresponding to blue-sensitive unit).

In this embodiment, as stated previously, a CCD array is used as a photoelectric element for the input scanner.

The readout means 1 includes an A/D conversion means which digitizes the signals representative of the color image signals detected by the CCD array, a correction means which corrects the CCD array, and a logarithm conversion means which converts the image signals representative of the color image that are corrected by the CCD correction means into logarithmic values.

A conventional A/D converter can be used as the A/D conversion means, and a conventional logarithm converter can be used as the logarithm conversion means.

The readout means 1 has a construction wherein, prior to obtaining the image signals of a high resolution which constitute the original data of the output print signals, pre-scanning is conducted for obtaining the outline information of a film image by means of reading scan beams having a larger spacing to thereby obtain pre-scan data Sp and fine-scanning is then conducted for reading out the film image by a higher resolving power to thereby obtain fine scan data Sf.

The image processing means 2 comprises an auto-setup computing section which sets up parameters for gray balance adjustment, contrast adjustment and the like of the image, a gradation processing section performing the gray balance adjustment and contrast adjustment of the fine scan data Sf based on the parameters set up by the auto-setup computing section, CRT which regenerates the pre-scan data Sp as a visible image, a monitor display and user interface section (User I/F) for the operator to correct manually the image processing parameters and a processing mean 4 which constitutes a characteristic feature of the present invention and which processes a low-frequency component for color correction and processes an intermediate-frequency and high-frequency components (hereinafter referred to as intermediate/high-frequency component) for control of granularity and sharpness processing.

Figure 6:
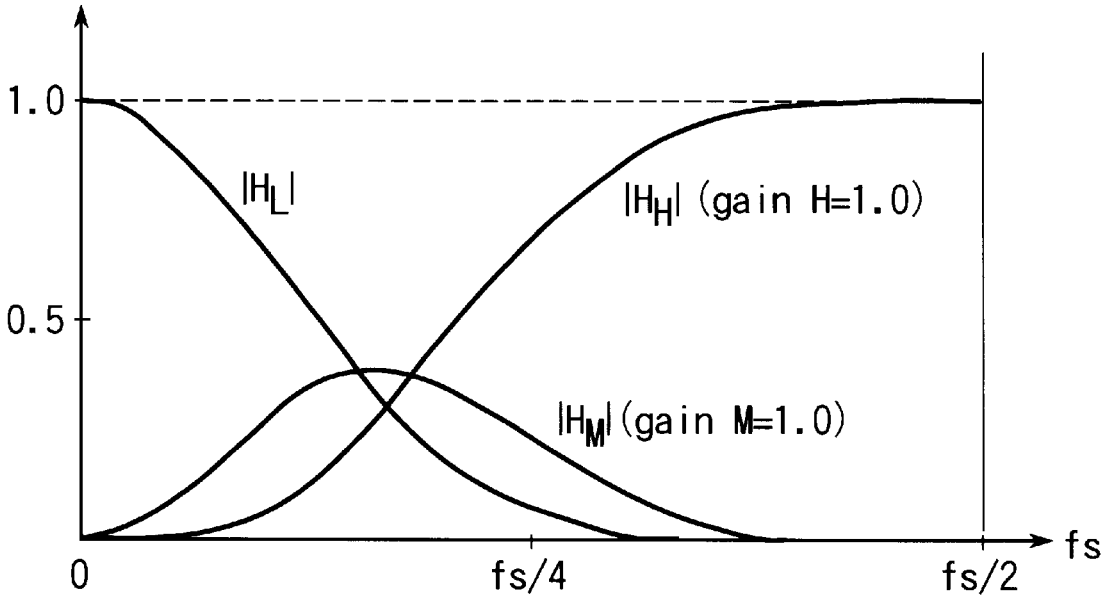
FIG. 6 illustrates the distributions of the low-frequency component, intermediate-frequency component and high-frequency component of an image signal.

The low-frequency component, intermediate-frequency component and high-frequency component of the image signal mean the frequency components having the respective distributions shown in FIG. 6. The intermediate-frequency component means a frequency component characterized by a distribution having a peak output at about ⅓ of the Nyquist frequency when regenerating the processed data as a visible image.

The low-frequency component means a frequency component characterized by a distribution having a peak output at 0 frequency. The high-frequency component means a frequency component characterized by a distribution having a peak output at Nyquist frequency. In this illustration, the sum of the low-frequency component, intermediate-frequency component and high-frequency component equals 1 at any frequency.

The functions of the stages are further explained below.

The readout means 1 pre-scans the color negative film image for obtaining the outline information of the film image by means of reading scan beams having a larger spacing. The pre-scanned 3-color analog signals are converted into digital data by means of an A/D conversion means; the resulting digital data are corrected by a CCD correction means; and the corrected data are then converted into data linear to the density of the negative film image by means of a logarithm conversion means to produce pre-scan data Sp output.

The pre-scan data Sp are fed to the auto-setup computing section and to the monitor display and user interface (hereinafter referred to as interface) of the image processing means 2. Here, the CRT displays the pre-scan data Sp as a visible image and also displays a sharpness processing menu so that the operator makes a selection. The signal S1 representative of the result of the selection is fed to the interface and further to the auto-setup computing section. Based on the pre-scan data Sp and the signal S1, the auto-setup computing section sends signals to the gradation processing at the fine scanning step that follows and to color processing as well as to the processing means 4 which constitutes a characteristic feature of the present invention.

Next, in the readout means 1, fine scan is performed to read out the color negative film image by means of reading scan beams having a narrow spacing. The fine-scanned 3-color analog signals are converted into digital data by means of an A/D conversion means; the resulting digital data are corrected by a CCD correction means; and the corrected data are then converted into data linear to the density of the negative film image by means of a logarithm conversion means to produce fine-scan data Sf output composed of RWB signals. The fine scan data Sf (RWB) are then gradation-processed, processed by the processing means 4 which constitutes a characteristic feature of the present invention, color-processed and sent to a printer unit.

Figure 2:
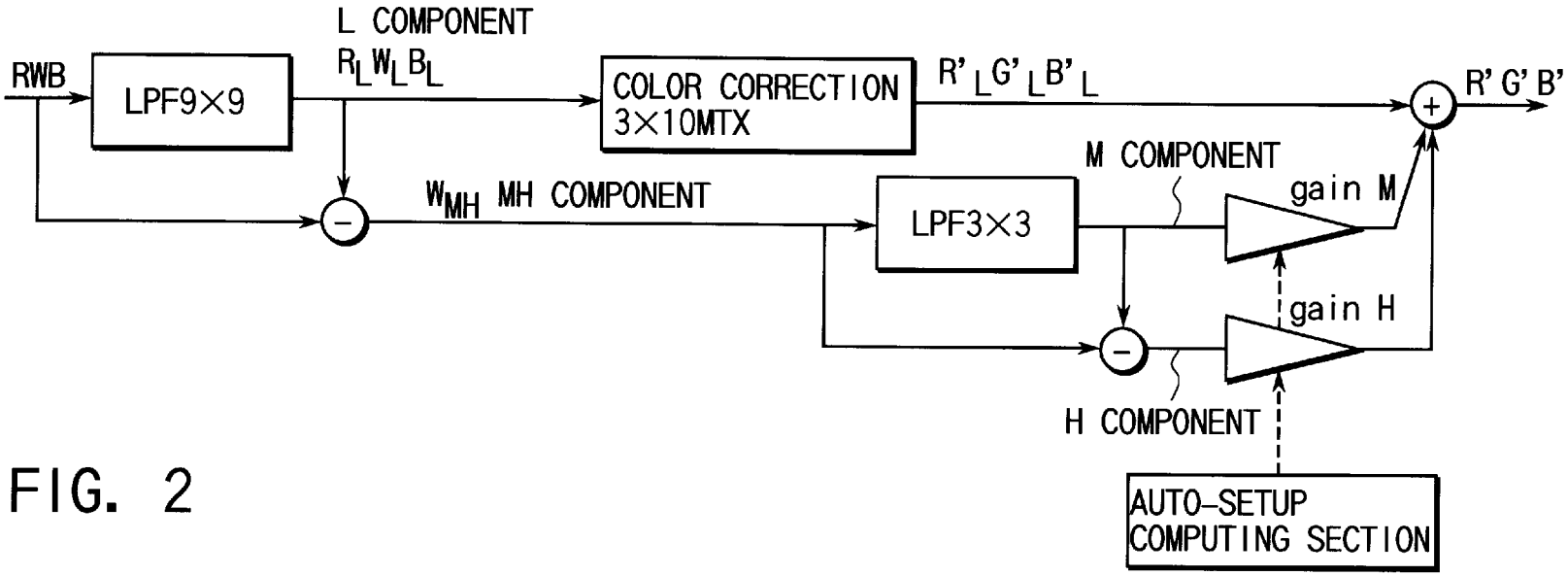
FIG. 2 is a block diagram illustrating the detail of the processing to be performed by the processing means 4 of FIG. 1.

FIG. 2 is a block diagram illustrating the detail of the processing to be conducted in the processing means 4.

As shown in FIG. 2, the fine scan data Sf (RWB) are filtered through a 9×9 low-pass filter, which comprises two stages of cascade-linked 5×5 low-pass filters having the convolution kernel represented by the following Equation 1 , to extract low-frequency components $R_L$, $W_L$ and $B_L$.

$$\begin{matrix} 1 & 4 & 6 & 4 & 1 \\ 4 & 16 & 24 & 16 & 4 \\ 6 & 24 & 36 & 24 & 6 \\ 4 & 16 & 24 & 16 & 4 \\ 1 & 4 & 6 & 4 & 1 \end{matrix} \qquad (1)$$

Then, intermediate/high-frequency components $R_{MH}$, $W_{MH}$ and $B_{MH}$ are extracted by subtracting the low-frequency components $R_L$, $W_L$ and $B_L$ from the fine scan data Sf (RWB).

The thus extracted low-frequency components $R_L$, $W_L$ and $B_L$ contain little of the noise of edges in color image, fine texture, film granularity and input scanner. On the other hand, intermediate/high-frequency components $R_{MH}$, $W_{MH}$ and $B_{MH}$ contain much of the noise of edges in color image, fine texture, film granularity and input scanner.

Then, the intermediate-frequency component $W_M$ is extracted from the intermediate/high-frequency component $W_{MH}$ by means of a 3×3 low-pass filter having the convolution kernel represented by the following Equation 2 and the high-frequency component $W_H$ is obtained by subtracting the intermediate-frequency component $W_M$ from the intermediate/high-frequency component $W_{MH}$.

$$\begin{matrix} 1 & 2 & 1 \\ 2 & 4 & 2 \\ 1 & 2 & 1 \end{matrix} \qquad (2)$$

The parameters set up by the processing means 4 are those indicated below, which will be described later in detail.

Color correction to the low-frequency component factor of the secondary matrix 3×10

For control of granularity and sharpness emphasizing processing to intermediate/high-frequency component gain M of the medium-frequency component (gain M) gain H of the high-frequency component (gain H).

Details of these parameters will be described later.

In the processing means 4, the color correction is made to the low-frequency components $R_L$, $W_L$ and $B_L$, while the control of granularity and sharpness emphasizing processing is made to the intermediate/high-frequency component $W_{MH}$ of the image signal obtained from the white-sensitive layer. Therefore, after being processed by the processing means 4, the color reproducing characteristics of the image signal depend on the low-frequency components $R_L$, $W_L$ and $B_L$, while image structural characteristics depend on the intermediate/high-frequency components $W_{MH}$. Because of this, since only the white-sensitive unit needs to be layers having good image structural characteristics (granularity, sharpness) among the three layer units of the color negative light-sensitive material, the advantages are that the layered construction of the present invention has a very high possibility of improving the image structural characteristics in comparison with the color negative light-sensitive material having the conventional layered construction and that there is also a higher possibility of improving the image structural characteristics of the print as a final product by use of the layered construction of the present invention.

Meanwhile, the color correction is generally known to emphasize the graininess. However, the problem of emphasis of graininess can be avoided by the processing means 4 of this embodiment, because the color correction is made only to the low-frequency component which does not contain the noise of the film granularity and scanner.

Concrete functions of the processing means 4 are explained below.

First, the color correction to the low-frequency components $R_L$, $W_L$ and $B_L$ is explained.

In this embodiment, the color correction is made by use of a 3×10 matrix. Although some other color correction means are possible, when the 3×10 matrix is used, the color correction equations are represented by the following Equation 3:

$$\begin{aligned} R_L' &= a11R_L + a12W_L + a13B_L + a14R_L + \\ &\quad a15G_L + a17R_LW_L + a18W_LB_L + a19B_LR_L + a1, \\ G_L' &= a21R_L + a22W_L + a23B_L + a24R_L + a25G_L + \\ &\quad a26B_L + a27R_LW_L + a28W_LB_L + a29B_LR_L + a2, \\ B_L' &= a31R_L + a32W_L + a33B_L + a34R_L + a35G_L + \\ &\quad a36B_L + a37R_LW_L + a38W_LB_L + a39B_LR_L + a3, \end{aligned} \qquad (3)$$

When the 3×10 matrix is used for the color correction, since the non-linear part, which is not corrected by a 3×3 matrix, is also corrected, it is possible to bring the color to a more desirable color.

The WBR-layered construction as described in this embodiment is characterized by that a21 and a23 take a large negative value while a22 takes a large positive value in order to restore the G ($G_L'$) signal.

If the color is required to be corrected more exactly than the correction using the 3×10 matrix, it is preferable to adopt the method for correction using a three-dimensional look up table (hereinafter referred to as 3D-LUT).

According to 3D-LUT method, in advance, the color space defined by $R_L$, $W_L$ and $B_L$ is divided into small cubes and the values at lattice points, namely $R_L'$, $G_L'$ and $B_L'$, are calculated and stored as 3D-LUT. Then, if the input image signals $R_L$, $W_L$ and $B_L$ fall on the lattice points, reference values of 3D-LUT are retrieved as output data. If the input signals do not correspond to the lattice points, a plurality of neighboring lattice points are referred to and the color-correction is made by means of three-dimensional interpolation to calculate $R_L'$, $G_L'$ and $B_L'$ as output values.

Next, the correlation between the spectral sensitivity characteristic of the color negative light-sensitive material of the present invention and the preferable digital color correction is described below.

If the spectral sensitivity characteristics of the color negative light-sensitive material of the present invention are $S_W(\lambda)$, $S_B(\lambda)$ and $S_R(\lambda)$ and if these fulfill the Luther condition, a calorimetric reproduction is possible. The calorimetric reproduction means the reproduction on a print of the color which provides the same chromaticity point as that of the original scene. Luther condition means that the spectral sensitivity characteristics are expressed by a linear connection of isochromatic functions as indicated by the following Equation 4:

$$\begin{aligned} S_R(\lambda) &= b11x(\lambda) + b12y(\lambda) + b13z(\lambda) \\ S_W(\lambda) &= b21x(\lambda) + b22y(\lambda) + b23z(\lambda) \\ S_B(\lambda) &= b31x(\lambda) + b32y(\lambda) + b33z(\lambda) \end{aligned} \qquad (4)$$

Wherein, x (λ), y (λ) and z (λ) are isochromatic functions of the human eyes.

In this case, since the color negative light-sensitive material of the present invention is capable of restoring exactly the information of the original scene caught by the human eyes, the colorimetric reproduction is possible if a high-level color correction (e.g., 3D-LUT color correction) is effected at the time when the color is restored.

As stated above, the most desirable case is the case where the spectral sensitivity of the color negative light-sensitive material having the white-sensitive unit satisfies the Luther condition. However, even in the case where the Luther condition cannot be completely satisfied, the optimization of the color correction makes it possible to provide a color reproduction acceptable for practical use.

Next, the processing of the intermediate-frequency component $W_M$ and the high-frequency component $W_H$ is explained below.

The signal of intermediate/high-frequency component, which has been processed for control of granularity and sharpness, is represented by the following Equation 5.

$$W_{MH}' = \text{gain } M \cdot W_M + \text{gain } H \cdot W_H \qquad (5)$$

Wherein, gain M is the gain of the intermediate-frequency component and gain H is the gain of the high-frequency component. The intermediate-frequency component $W_M$ contains a larger amount of the component which gives an impression of graininess to human eyes, relative to the high-frequency component $W_H$.

Meanwhile, the high-frequency component $W_H$ contains a larger amount of the detail information which gives an impression of sharpness to human eyes, relative to the intermediate-frequency component $W_M$. Accordingly, a desirable balance between the graininess and the sharpness can be achieved by increasing the gain H to emphasize the sharpness and by setting the gain M to a smaller value than the gain H to control the granularity.

Finally, the processing means 4 recombines the low-frequency component after being color-corrected and the intermediate/high-frequency component after being processed for control granularity and sharpness, as indicated by the following Equation 6, and the fine scan data (R', G', B') are obtained after the processing by the processing means 4.

$$R'=R_L'+W_{MH}'$$

$$G'=G_L'+W_{MH}'$$

$$B'=B_L'+W_{MH}' \quad (6)$$

The processed signal undergoes a color processing for conversion into data suitable to a recording material, such as a color paper, to produce fine scan data (c, m, y) corresponding to the amounts of dyes which form color on the color paper.

Finally, the reproduction means 3 reproduces an image on the color paper.

Figure 3:
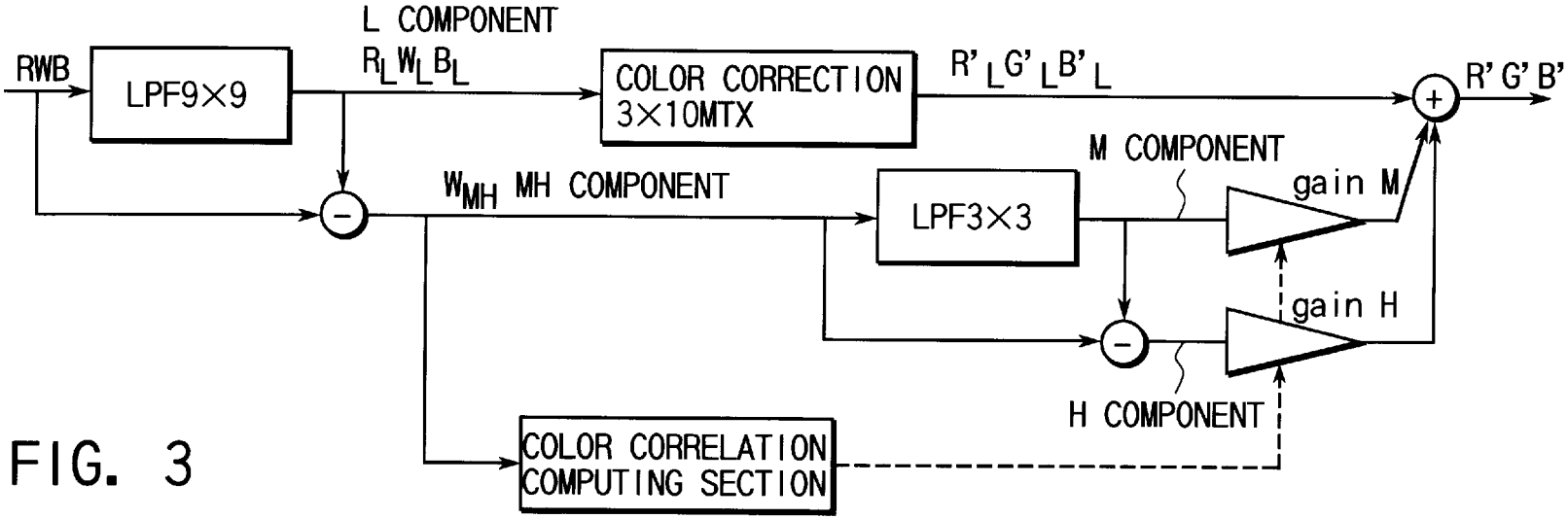
FIG. 3 is another block diagram illustrating the detail of the processing to be performed by the processing means 4 of FIG. 1.
Figure 4:
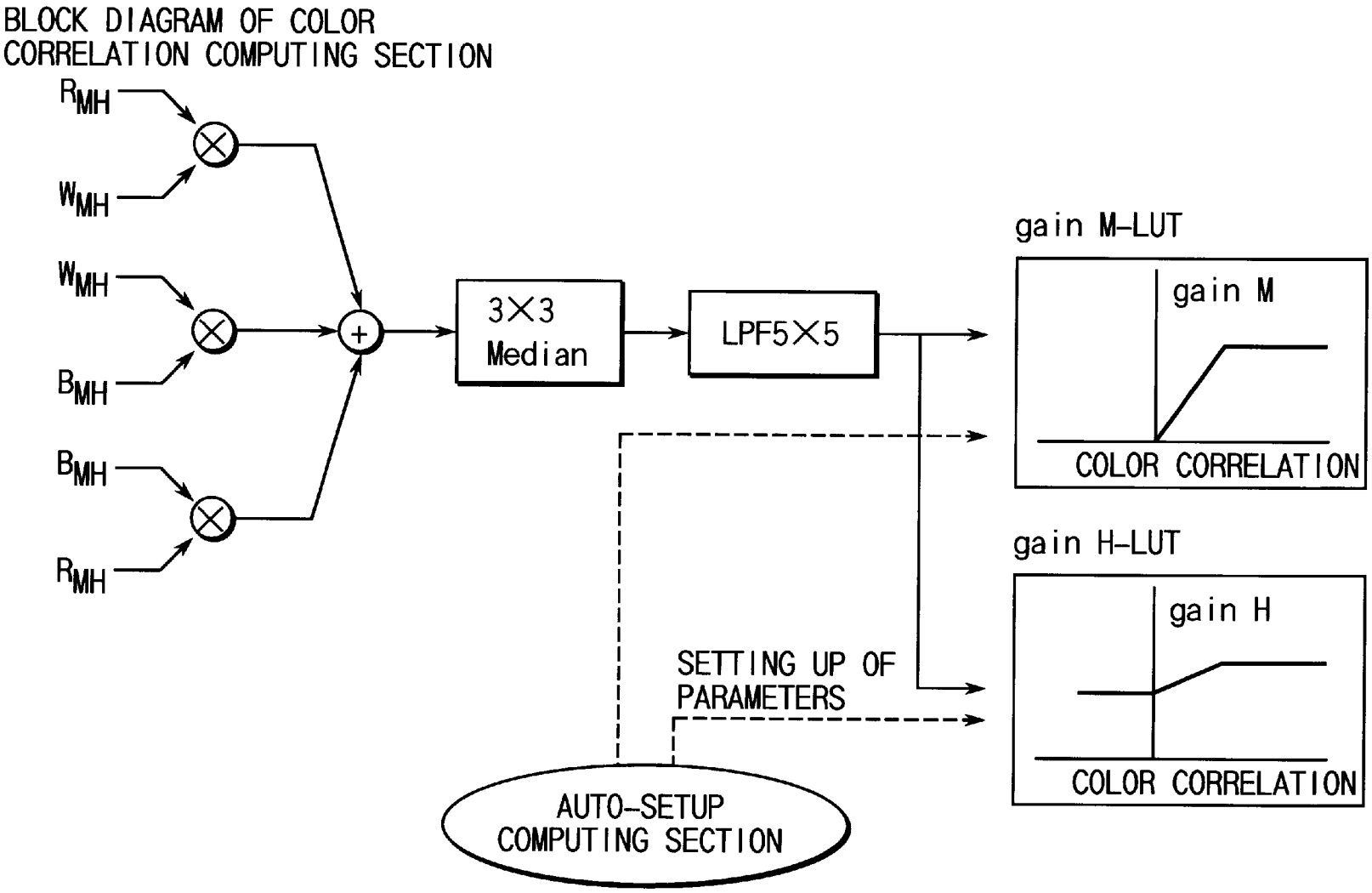
FIG. 4 is a block diagram of the color correlation computing section of FIG. 3.

In the aforementioned processing for control of granularity and sharpness (Equation 5), gain M and gain H each took a fixed value within a frame of image, but the gain M and the gain H can each be made variable appropriately in order to enable the image quality to be further improved. Based on this idea, other examples of the processing means 4 are shown in FIGS. 3 and 4.

More specifically, the gains can be different between the linear region and edge region of the image, as illustrated below.

The linear region of image means the region where the change in image density is within a small range and gradual, while the edge region means the region where the change in image density is large and abrupt.

Linear region of image: reduce gain to control granularity

Edge region of image: increase gain to emphasize sharpness

In particular, the effect is remarkable, because the granularity can be controlled by reducing the gain of the intermediate-frequency component (gain M) of the linear region of image without decreasing the sharpness.

The embodiment of the processing means 4, in which the gain is changed appropriately, is explained below.

The processing means 4 illustrated in FIG. 3 includes a correlation computing means (color correlation computing section) which calculates correlation for three signals R, W and B of intermediate/high frequency in addition to the processing means shown in FIG. 2. As illustrated in the block diagram of the color correlation computing section of FIG. 4, the function of the correlation computing means comprises the steps of calculating the value of correlation $\epsilon$ between colors for the intermediate/high-frequency components $W_{MH}$, $R_{MH}$ and $B_{MH}$ of the fine scan data Sf and thereafter referring to gain M-LUT and gain H-LUT based on the calculated $\epsilon$ to thereby obtain the values of gain M and gain H, respectively.

The process for calculating the value of correlation $\epsilon$ is explained below.

The values of correlation $\epsilon$RW, $\epsilon$WB and $\epsilon$BR between colors for intermediate/high-frequency components are obtained from the following Equation 7:

$$\epsilon RW = (1/25)\sum_{-2}^{+2}\sum_{-2}^{+2} R_{MH}(iw, jw)W_{MH}(iw, jw) \quad (7)$$

$$\epsilon WB = (1/25)\sum_{-2}^{+2}\sum_{-2}^{+2} W_{MH}(iw, jw)B_{MH}(iw, jw)$$

$$\epsilon BR = (1/25)\sum_{-2}^{+2}\sum_{-2}^{+2} B_{MH}(iw, jw)R_{MH}(iw, jw)$$

wherein $\epsilon$RW: a value of correlation between R and W; $\epsilon$WB: a value of correlation between W and B; $\epsilon$BR: a value of correlation between B and R.

The calculation of values of correlation according to the Equation 7 consists in the multiplication between the signals of the intermediate/high-frequency components of two colors and filtering through a 5×5 low-pass filter having the convolution kernel represented by the following Equation 8. The normalization constant 1/25 may be omitted, because this constant contributes only to the change of the scale of the values of correlation.

$$\begin{matrix} 1 & 1 & 1 & 1 & 1 \\ 1 & 1 & 1 & 1 & 1 \\ 1 & 1 & 1 & 1 & 1 \\ 1 & 1 & 1 & 1 & 1 \\ 1 & 1 & 1 & 1 & 1 \end{matrix} \quad (8)$$

The values of correlation between colors exhibit the following characteristics. In the linear region of image, where most of noise is induced by the film granularity, the signals emerge at random for each of the components and therefore the value of correlation approaches 0. Meanwhile, at edge region of image, the signals emerge similarly for each of the components and therefore the value of correlation becomes larger. A value of correlation that is negative is deemed to be indicative of the linear region of image in the embodiment of the present invention, because the value of correlation cannot become negative at the edge region of image signals. Accordingly, it is possible to deem that the values of correlation $\epsilon$RW, $\epsilon$WB and $\epsilon$BR belong to the linear region of image where most of noise is induced by graininess if these values are smaller than a predetermined threshold value, whereas it is possible to deem that the values of correlation $\epsilon$RW, $\epsilon$WB and $\epsilon$BR belong to the edge region of image if these values are larger than a predetermined threshold value.

The summing up of the values of correlation between colors is expressed by the following Equation 9.

$$\epsilon=\epsilon RW+\epsilon WB+\epsilon BR \quad (9)$$

As shown in FIG. 4, it is also possible to perform LPF 5×5 after the multiplication between the signals representative of colors.

Figure 5A:
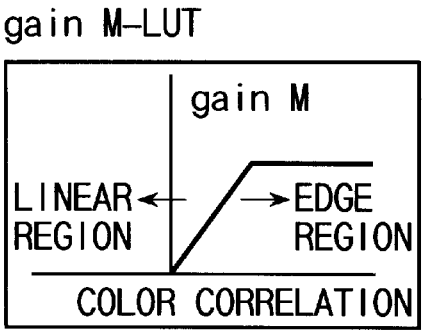
FIG. 5A illustrates typical characteristics of Look Up Table gain M-LUT.
Figure 5B:
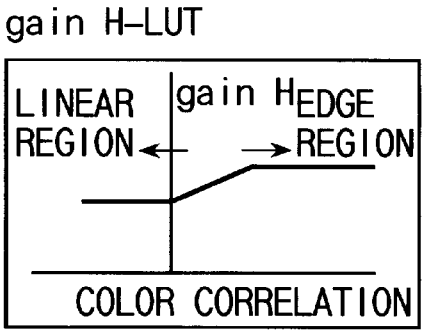
FIG. 5B illustrates typical characteristics of Look Up Table gain H-LUT.

Based on the thus calculated values of correlation between colors, gain M and gain H are obtained by referring to the lookup table as shown in FIG. 5A and FIG. 5B, respectively. These are expressed by the following Equations 10-1 and 10-2.

$$\text{gain } M=\text{gain } M\text{-LUT}(\epsilon) \quad (10\text{-}1)$$

$$\text{gain } H=\text{gain } H\text{-LUT}(\epsilon) \quad (10\text{-}2)$$

A signal, which has been processed for control of granularity and sharpness, is obtained by multiplying the intermediate-frequency component $W_M$ of W and the high-frequency component $W_H$ of W by gain M and gain H, respectively. This is expressed by the following Equation 11.

$$W_{MH}'=\text{gain } M\cdot W_M+\text{gain } H\cdot W_H \quad (11)$$

The fine-scan data processed by the processing means 4 is obtained as the sum of a low-frequency component which has undergone a color correction and a signal which has undergone the processing for control of granularity and sharpness. In this case, the gain M-LUT and gain H-LUT of lookup table are determined a default value by the enlargement ratio of print and species of films, then amount of correction calculated by the auto-setup unit and the value indicated by the interface are added to the default value, and the integrated results are set to the hard ware.

FIG. 5A shows the typical characteristics of Look Up Table gain M-LUT.

FIG. 5B shows the typical characteristic of Look Up Table grain H-LUT.

As shown in FIG. 5A and FIG. 5B, if an action is taken to strongly control the granularity by diminishing the value of gain M at the linear region, the resultant effect is the controlled granularity on the print.

As the amount of overlap of spectral sensitivity becomes larger at edge region, the correlation becomes stronger. For example, since the amount of overlap of spectral sensitivity between R and W layers or between W and B layers is greater than that between R and B layers, $\epsilon$RW and $\epsilon$WB tend to be larger than $\epsilon$RB at edge region.

The color negative light-sensitive material having a white-sensitive unit according to the present invention has an advantage that, because of the larger amount of overlap of the three spectral sensitivities, the values of correlation at edge region become larger to enable a clearer separation between edge region and linear region, which makes it easier to obtain the effect of controlling granularity and emphasizing sharpness, in comparison with color negative light-sensitive material comprising the conventional R, G and B layers.

As stated above, it is possible to obtain a print superior both in color reproduction and in image structural characteristics by processing, using an image processing means including the processing means 4, the image which is produced by photographing using a color negative light-sensitive material having a white-sensitive unit and developing the material.

The light-sensitive material of the present invention needs to have at least one unit light-sensitive layer in the three light-sensitive layers formed on a support. A typical example of the light-sensitive materials of the present invention is a silver halide photographic light-sensitive material having, on the support, at least one unit light-sensitive layer constituted by a plurality of silver halide emulsion layers which are sensitive to the same color but which have different sensitivities or speeds. In a multi-layered silver halide color photographic light-sensitive material, a generally adopted order of the unit light-sensitive layers from the support is a red-sensitive layer, a green-sensitive layer and a blue-sensitive layer, wherein any one of the layers is replaced with a white-sensitive layer. However, according to the intended use, this order of layers may be reversed, or a layer having a different color sensitivity may be sandwiched between layers having the same color sensitivity in accordance with the application. Non light-sensitive layers can be formed between the silver halide light-sensitive layers and as the uppermost layer and the lowermost layer. These non light-sensitive layers can contain couplers, DIR compounds, color mixture preventives and the like to be described later. As a plurality of silver halide emulsion layers constituting a unit light-sensitive layer, a two-layered structure of high-speed and low-speed emulsion layers can be preferably arranged such that the sensitivity or speed is sequentially decreased toward a support as described in West German Patent 1,121,470 or British Patent 923,045. Alternatively, as described in JP-A-57-112751, JP-A-62-200350, JP-A-62-206541 and JP-A-62-206543, layers may be arranged such that a low-speed emulsion layer is formed remotely from a support and a high-speed layer is formed close to the support.

Further, as described in JP-B-49-15495 ("JP-B" means Published Examined Japanese Patent Application), three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer, i.e., the three layers having different sensitivities may be arranged such that the sensitivity is sequentially decreased toward the support. Also, when the light-sensitive material comprises the three layers having different sensitivities or speeds, these layers may be arranged from far to near to the support in the order of medium-speed emulsion layer/high-speed emulsion layer/low-speed emulsion layer within a layer sensitive to one and the same color sensitivity as described in JP-A-59-202464.

In addition, an order of high-speed emulsion layer/low-speed emulsion layer/medium-speed emulsion layer, or an order of low-speed emulsion layer/medium-speed emulsion layer/high-speed emulsion layer may be adopted. Furthermore, the arrangement can be changed as described above, even when four or more layers are formed.

A preferable silver halide to be used in photographic emulsion layers of the photographic light-sensitive material of the present invention is silver iodobromide, silver iodochloride or silver iodochlorobromide containing about 30 mol % or less of silver iodide. A particularly preferable silver halide is silver iodobromide or silver iodochlorobromide each containing about 2 mol % to about 10 mol % of silver iodide.

The silver halide grains contained in the photographic emulsion may be in the form of regular crystals, such as cubes, octahedrons and decatetrahedons, irregular crystals, such as spheres and tabulars, crystals having defects such as twin planes, or composite shapes thereof.

The grain sizes of the silver halide may range from fine grains having a grain diameter of about 0.2 $\mu$m or less or to larger grains having a diameter of the projected area of a grain of up to about 10 $\mu$m. Further, the silver halide emulsion may be a poly-disperse emulsion or a monodisperse emulsion.

The silver halide photographic emulsions usable in the present invention can be prepared by the methods described, for example, in Research Disclosure (hereinafter abbreviated as RD) No. 17643 (December 1978), pages 22-23, "I. Emulsion Preparation and Types"; RD No. 18716 (November 1979), page 648, and RD No. 307105 (November 1989), pages 863–865; P. Glafkides, "Chimie et Physique Photographiques", Paul Montel, 1967; G. F. Duffin, "Photographic Emulsion Chemistry", Focal Press, 1966; and V. L. Zelikman et al., "Making and Coating Photographic Emulsion", Focal Press, 1964.

Also preferable is the monodisperse emulsions described in U.S. Pat. Nos. 3,574,628 and 3,655,394, and British Patent 1,413,748.

Further, tabular grains having an aspect ratio of about 3 or more can also be used in the present invention. The tabular grains can be easily prepared by the methods described in Gutoff, "Photographic Science and Engineering", Vol. 14, pp. 248–257 (1970); U.S. Pat. Nos. 4,434,226; 4,414,310; 4,433,048 and 4,439,520, and British Patent 2,112,157.

The crystal structure may be uniform, may have different halogen compositions in its interior and exterior, or may be a layered structure. Alternatively, silver halides having different compositions may be joined by an epitaxial junction, or a compound other than a silver halide such as silver rhodanide or lead oxide may be joined. A mixture composed of grains having various crystal forms may also be used.

The above-mentioned emulsion needs to be a negative-type emulsion, although it may be of a surface latent image type which forms a latent image mainly on the surface of the grains, an inner latent image type which forms a latent image inside the grains, or other type which forms a latent image both inside and outside the grain. The emulsion belonging to the inner latent image type may be of the inner latent image type having a core/shell structure described in JP-A-63-264740, the method for making which emulsion is described in JP-A-59-133542. The thickness of the shell for this emulsion is preferably 3 to 40 nm and most preferably 5 to 20 nm, although the thicknesses vary depending on processing conditions for development and the like.

Prior to the use in the light-sensitive material of present invention, the silver halide emulsion usually undergoes a chemical ripening, a physical ripening, and a spectral sensitization steps. The additives which are used at such steps are described in RD No. 17,643, RD No. 18,716 and RD No. 307,105 and are summarized later in a table with the indications of the relevant places of description.

In the light-sensitive material of the present invention, a mixture of two or more emulsions, which differ from one another in at least one of the characteristics selected from the group consisting of grain size, grain size distribution, halogen composition, shape of grain and sensitivity, can be used in the same layer.

It is preferable to use silver halide grains having surface-fogged grain described in U.S. Pat. No. 4,082,553, silver halide grains having internally fogged grain described in U.S. Pat. No. 4,626,498 and JP-A-59-214852, or colloidal silver in a light-sensitive silver halide emulsion layer and/or in a substantially non light-sensitive hydrophilic colloidal layer. The silver halide grains having internally fogged grain or surface-fogged silver halide grains capable of being developed uniformly (non-imagewise) irrespective of the unexposed and exposed area portions of the light-sensitive material. The method for making the internally fogged or surface-fogged silver halide grains is described in U.S. Pat. No. 4,626,498 and JP-A-59-214852. The silver halide, which constitutes the inner core of core/shell-type silver halide grains having the internally fogged grain, may have a different halogen composition. The silver halide grains having internally fogged grain or surface-fogged grain may be any silver halide selected from the group consisting of silver chloride, silver chlorobromide, silver iodobromide and silver chloroiodobromide. The average grain sizes of these fogged silver halide grains are in the range of 0.01 to 0.75 $\mu$m, and more preferably in the range of 0.05 to 0.6 $\mu$m. Although the emulsion may be made up of grains having regular shapes or may be a polydisperse emulsion, it is preferably a monodisperse emulsion (in which at least 95 wt % or number of silver halide grains have grain diameters falling within the range of ±40% or less of the average diameter).

It is preferable to use non light-sensitive silver halide fine grains in the present invention. The non light-sensitive silver halide fine grains mean the silver halide fine grains which are not sensitized in the imagewise exposure for forming a dye image and are substantially undeveloped when processed for development. Preferably, the non light-sensitive silver halide fine grains are not fogged in advance. The fine-grain silver halide has a silver bromide content of 0 to 100 mol %. If necessary, the fine-grain silver halide may further contain silver chloride and/or silver iodide. Preferred silver iodide content is 0.5 to 10 mol %. The average grain diameter (average value of the equivalent-circle diameters of projected areas) of the fine-grain silver halide is preferably 0.01 to 0.5 $\mu$m, and more preferably 0.02 to 0.2 $\mu$m.

The fine-grain silver halide can be prepared by the same method as that for a conventional light-sensitive silver halide. No optical sensitization or spectral sensitization is necessary for the surface of the grains of the silver halide. However, it is preferable to add to the silver halide grains a known stabilizer such as a triazole compound, an azaindene compound, a benzothiazole compound, a mercapto compound or a zinc compound, before the silver halide is added to a coating solution. A layer, which contains the fine-grain silver halide, may further contain colloidal silver.

The coating amount of silver of the light-sensitive material of the present invention is preferably 6.0 g/m$^2$ or less, and most preferably 4.5 g/m$^2$ or less.

The photographic additives usable in the present invention are also described in RD and the following table shows the additives together with the relevant places of description.

| | Additives | RD17,643 | RD18,716 | RD307,105 |
|---|---|---|---|---|
| 1. | Chemical sensitizers | page 23 | page 648, right column | page 866 |
| 2. | Sensitivity increasing agents | | page 648, right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultravioiet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surface active agents | pages 26–27 | page 650, right column | pages 875–876 |
| 9. | Antistatic agents | page 27 | page 650, right column | pages 876–877 |
| 10. | Matting agents | | | pages 878–879 |

Various dye formation couplers can be used in the light-sensitive material of the present invention, and the following couplers are particularly preferable.

Yellow couplers: couplers represented by Formulas (I) and (II) in European Patent 502,424A; couplers (particularly Y-28 on page 18) represented by Formulas (1) and (2) in European Patent 513,496A; a coupler represented by Formula (I) in claim 1 of European Patent 568,037A; a coupler represented by Formula (I) in column 1, lines 45 to 55, in U.S. Pat. No. 5,066,576; a coupler represented by Formula (I) in paragraph 0008 of JP-A-4-274425; couplers (particularly D-35 on page 18) described in claim 1 on page 40 in European Patent 498,381A1; couplers (particularly Y-1 (page 17) and Y-54 (page 41)) represented by Formula (Y) on page 4 in European Patent 447,969A1; and couplers (particularly II-17 and II-19 (column 17) and II-24(column 19)) represented by Formulas (II) to (IV) in column 7, lines 36–58, in U.S. Pat. No. 4,476,219.

Magenta couplers: JP-A-3-39737 L-57 (page 11, lower right column), L-68 (page 12, lower right column), and L-77 (page 13, lower right column)); [A-4]-63 (page 134), and [A-4]-73 and [A-4]-75 (page 139) in European Patent 456,257; M-4 and M-6 (page 26), and M-7 (page 27) in European Patent 486,965; M-45 (page 19) in European Patent 571,959A; (M-1) (page 6) in JP-A-5-204106; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by Formula (Ia) and (Ib) described in claim 1 of JP-A-6-67385.

Polymer couplers: P-1 and P-5 (page 11) in JP-A-2-44345.

Couplers for forming a colored dye having a proper diffusibility are preferably those described in U.S. Pat. No. 4,366,237, British Patent 2,125,570, European Patent 96,873B and West German Laid-open Patent Application 3,234,533.

Usable couplers for correcting unnecessary absorption of a colored dye are yellow colored cyan couplers (particularly YC-86 on page 84) represented by Formulas (CI), (CII), (CIII) and (CIV) described on page 5 in European Patent 456,257A1; yellow colored magenta couplers ExM-7 (page 202), Ex-1 (page 249) and Ex-7 (page 251) in European Patent 456,257A1; magenta colored cyan couplers CC-9 (column 8) and CC-13 (column 10) described in U.S. Pat. No. 4,833,069 (2) (column 8) in U.S. Pat. No. 4,837,136; and colorless masking couplers (particularly compound examples on pages 36 to 45) represented by Formula (A) described in claim 1 of WO92/11,575, but the use amount of these couplers is preferably reduced to a minimum in the color light-sensitive material of the present invention.

Examples of a compound (including a coupler) which reacts with a developing agent oxidized form and releases a photographically useful compound residue are as follows. Development inhibitor release compounds: compounds (particularly T-101 (page 30), T-104 (page 31), T-113 (page 36), T-131 (page 45), T-144 (page 51) and T-158 (page 58)) represented by Formulas (I), (II), (III) and (IV) described on page 11 in European Patent 378,236A1; compounds (particularly D-49 (page 51)) represented by Formula (I) described on page 7 in European Patent 436,938A2; compounds (particularly (23) (page 11)) represented by Formula (I) in European Patent 568,037A; compounds (particularly I-(1) on page 29) represented by Formulas (I), (II) and (III) described on pages 5 and 6 in European Patent 440,195A2; bleaching accelerator release compounds: compounds (particularly (60) and (61) on page 61) represented by Formulas (I) and (I') described on page 5 in European Patent 310,125A2; and compounds (particularly (7) (page 7)) represented by Formula (I) described in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE described in claim 1 of U.S. Pat. No. 4,774,181; development accelerators or fogging agent release compounds: compounds (particularly compound (I-22) in column 25) represented by Formulas (1), (2) and (3) described in column 3 of U.S. Pat. No. 4,656,123, and compounds represented by ExZK-2 described on page 75, lines 36 to 38, in European Patent 450,637A2; and compounds which release a group which does not function as a dye unless it splits off: compounds (particularly Y-1 to Y-19 in columns 25 to 36) represented by Formula (I) in claim 1 of U.S. Pat. No. 4,857,447.

Preferable examples of additive other than couplers are as follows.

Dispersants of an oil-soluble organic compound: P-3, P-5, P-16, P-19, P-25, P-30, P-42, P-49, P-54, P-55, P-66, P-81, P-85 and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6) and I-(12) (columns 4 and 5)) represented by Formula (I) in column 2, lines 54 to 62, in U.S. Pat. No. 4,978,606, and formulas (particularly compound 1 (column 3)) in column 2, lines 5 to 10, in U.S. Pat. No. 4,923,787; stain inhibitors: Formulas (I) to (III) on page 4, lines 30 to 33, particularly I-47, I-72, III-1 and III-27 (pages 24 to 48) in European Patent 298,321A; brown inhibitors: A-6, A-7, A-20, A-21, A-23, A-24, A-25, A-26, A-30, A-37, A-40, A-42, A-48, A-63, A-90, A-92, A-94 and A-164 (pages 69 to 118) in European Patent 298,321A, II-1 to III-23, particularly III-10, in columns 25 to 38 of U.S. Pat. No. 5,122,444, I-1 to III-4, particularly II-2, on pages 8 to 12 in European Patent 471,347A, and A-1 to A-48, particularly A-39 and A-42, in columns 32 to 40 of U.S. Pat. No. 5,139,931; materials which reduce the use amount of a color enhancer or a color amalgamation inhibitor: I-1 to II-15, particularly I-46, on pages 5 to 24 in European Patent 411,324A; formalin scavengers: SCV-1 to SCV-8, particularly SCV-8, on pages 24 to 29 in European Patent 477,932A; film hardeners: H-1, H-4, H-6, H-8 and H-14 on page 17 in JP-A-1-214845, compounds (H-1 to H-54) represented by Formulas (VII) to (XII) in columns 13 to 23 of U.S. Pat. No. 4,618,573, compounds (H-1 to H-76), particularly H-14, represented by Formula (6) on page 8, lower right column, in JP-A-2-214852, and compounds described in claim 1 of U.S. Pat. No. 3,325,287; development inhibitor precursors: P-24, P-37 and P-39 (pages 6 and 7) in JP-A-62-168139 and compounds described in claim 1, particularly 28 and 29, in column 7, of U.S. Pat. No. 5,019,492; antiseptic agents and mildewproofing agents: I-1 to III-43, particularly II-1, II-9, II-10, II-18 and III-25, in columns 3 to 15 of U.S. Pat. No. 4,923,790; stabilizers and antifoggants: I-1 to (14), particularly I-1, 60, (2) and (13), in columns 6 to 16 of U.S. Pat. No. 4,923,793, and compounds 1 to 65, particularly compound 36, in columns 25 to 32 of U.S. Pat. No. 4,952,483; triphenylphosphine selenide: compound 50 described in JP-A-5-40324; dyes: a-1 to b-20, particularly a-1, a-12, a-18, a-27, a-35 and a-36 and b-5 on pages 15 to 18, and V-1 to V-23, particularly V-1, on pages 27 to 29 in JP-A-3-156450, F-I-1 to F-II-43, particularly F-I-11 and F-II-8, on pages 33 to 55 in European Patent 445,627A, III-1 to III-36, particularly III-1 and III-3, on pages 17 to 28 in European Patent 457,153A, fine crystal dispersions of Dye-1 to Dye-124 on pages 8 to 26 in WO 88/04,794, compounds 1 to 22, particularly compound 1, on pages 6 to 11 in European Patent 319,999A, compounds D-1 to D-87 (pages 3 to 28) represented by Formulas (1) to (3) in European Patent 519,306A, compounds 1 to 22 (columns 3 to 10) represented by Formulas (I) in U.S. Pat. No. 4,268,622, and compounds (1) to (31) (columns 2 to 9) represented by Formulas (I) in U.S. Pat. No. 4,923,788; and UV absorbents: compounds (18b) to (18r) and 101 to 427 (pages 6 to 9) represented by Formulas (1) in JP-A-46-3335, compounds (3) to (66) (pages 10 to 44) represented by Formula (I) and compounds HBT-1 to HBT-10 (page 14) represented by Formula (III) in European Patent 520,938A, and compounds (1) to (31) (columns 2 to 9) represented by Formula (1) in European Patent 521,823A.

The present invention can be applied to various color light-sensitive materials such as a color negative film for a general purpose or a movie and a color reversal film for a slide or a television. The present invention is also suited to film units with lens described in JP-B-2-32615 and JU-B 3-39784 ("JU-B" means Published Examined Japanese Utility Model Application).

A support which can be suitably used in the present invention is described in, e.g., RD No. 17,643, page 28, RD No. 18,716, from right column, page 647, to left column, page 648, and RD No. 307,105, page 879.

In the light-sensitive material of the present invention, the sum total of film thicknesses of all hydrophilic colloid layers on the side having the emulsion layers is preferably 28 μm or less, more preferably 23 μm or less, particularly preferably 18 μm or less, and most preferably 16 μm or less. A film swell speed $T_{1/2}$ is preferably 30 seconds or less, and more preferably 20 seconds or less. $T_{1/2}$ is defined as a time which the film thickness requires to reach ½ of a saturation film thickness which is 90% of a maximum swell film thickness reached when processing is performed by using a color developer at 30° C. for 3 min. and 15 seconds. The film thickness means the thickness of a film measured under moisture conditioning at a temperature of 25° C. and a 55% relative humidity at (two days). $T_{1/2}$ can be measured by using a swell meter described in Photographic Science Engineering, A. Green et at., Vol. 19, No. 2, pp.124–129. $T_{1/2}$ can be adjusted by adding film hardening agent to gelatin as a binder or changing aging conditions after coating. The swell ratio is preferably 150 to 400%. The swell ratio can be calculated from the maximum swell film thickness under the conditions mentioned above by using (maximum swell film thickness-film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant, described above. The swell ratio of the back layers is preferably 150 to 500%.

The light-sensitive material of the present invention can be processed for development by a conventional method described in aforesaid RD No. 17,643, pages 28 and 29, RD No. 18,716, page 651, from left column to right column, and RD No. 307,105, pages 880 and 881.

The processing solution for a color negative film of the present invention is described below.

The color developing solution of the present invention may contain the compounds described in JP-A-4-121739, page 9, upper right column, line 1 to page 11, lower left column, line 4. Preferred developing agents for the rapid processing are 2-methyl-4-(N-ethyl-N-(2-hydroxyethyl) amino) aniline, 2-methyl-4-(N-ethyl-N-(3-hydroxypropyl) amino)aniline and 2-methyl-4-(N-ethyl-N-(4-hydroxybutyl) amino)aniline.

The concentration of these color developing agents is preferably 0.01 to 0.08 mol, more preferably 0.015 to 0.06 mol, and most preferably 0.02 to 0.05 mol per liter of the color developing solution. The concentration of these color developing agents in a replenisher solution of the color developing solution is preferably 1.1 to 3 times, more preferably 1.3 to 2.5 times, the concentration in the color developing solution.

The color developing solution of the present invention may contain a hydroxylamine as a general purpose preservative. If a higher-level preservation is required, preferable preservatives are hydroxylamine derivatives having substituents such as alkyl, hydroxyalkyl, sufoalkyl and carboxyalkyl groups, preferred examples of which are N,N-di (sulfoethyl)hydroxylamine, monomethylhydroxylamine, dimethylhydroxylamine, monoethylhydroxylamine, diethylhydroxylamine and N,N-di(carboxyethyl)hydroxylamine. Among the above-mentioned derivatives, N,N-di (sulfoethyl)hydroxylamine is particularly preferable. Although any of these derivatives may be used in combination with hydroxylamine, preferably one, or two or more of these derivative are used instead of hydroxylamine.

The concentration of the preservative is preferably 0.02 to 0.2 mol, more preferably 0.03 to 0.15 mol, and most preferably 0.04 to 0.1 mol per liter of the color developing solution. The concentration of the preservative in a replenisher solution of the color developing solution is 1.1 to 3 times the concentration in the mother solution (i.e., the solution in the processing tank). In order to prevent the tarring of the developing agent oxidized form, the color developing solution contains a sulfite. The concentration of the sulfite is preferably 0.01 to 0.05 mol and particularly preferably 0.02 to 0.04 mol per liter of the color developing solution. The concentration of the sulfite in a replenisher solution of the color developing solution is 1.1 to 3 times the concentration mentioned above.

The pH value of the color developing solution is preferably 9.8 to 11.0 and particularly preferably 10.0 to 10.5. The pH value of a replenisher solution of the color developing solution is set to a value preferably 0.1 to 1.0 above the above-mentioned values. In order to maintain pH at the above-mentioned values in a stable manner, a known buffer solution such as a carbonate, a phosphate, a sulfosalicylate or a borate is used.

The quantity of replenisher of the color developing solution is preferably 80 to 1,300 mL per $m^2$ of the light-sensitive material. From the viewpoint of reducing the polluting load to environment, the quantity should be reduced and is preferably 80 to 600 mL, more preferably 80 to 400 mL.

The bromide ion concentration in the color developing solution is usually 0.01 to 0.06 mol per liter of the color developing solution. Preferably, the bromide ion concentration is set to 0.015 to 0.03 mol per liter of the color developing solution for the purpose of fog inhibition and enhancement of discrimination while maintaining the sensitivity and for overcoming the problem of graininess. If the bromide ion concentration is set to the above-mentioned range, the replenisher solution needs to contain the bromide ions at the concentration given by the following equation, provided that the replenisher solution preferably contains no bromide ion if the calculated value C is negative.

$$C=A-W/V$$

where

C: Bromide ion concentration (mol/L) of the replenisher solution of the color developing solution;

A: Target bromide ion concentration (mol/L) in the color developing solution;

W: Amount (mol) of the bromide ions which dissolve into the color developing solution from the light-sensitive material when 1 $m^2$ of the light-sensitive material was processed for development; and V: Quantity of replenisher of the color developing solution per $m^2$ of the light-sensitive material.

If the quantity of replenisher is reduced or the bromide ion concentration is set to a large value, it is preferable to use development accelerators, such as pyrazolidones represented by 1-phenyl-3-pyrazolidone or 1-phenyl-2-methyl-2-hydroxymethyl-3-pyrazolidone, and thioether compounds represented by 3,6-dithia-1,8-octanediol, as a means for increasing the sensitivity.

The compounds or processing conditions, which are described in JP-A-4-125558, page 4, lower left column, line 16 to page 7, lower left column, line 6, can be applied to the processing solution having a bleaching power of the present invention.

A preferable bleaching agent has a redox potential of 150 mV or more. Preferred examples of the bleaching agents are described in JP-A-5-72694 and JP-A-5-173312. Particularly preferred examples are 1,3-diaminopropanetetraacetic acid and ferric complex salts of the compounds shown as example 1 in JP-A-5-173312.

It is preferable to use the ferric complex salts of the compounds described in JP-A-4-251845, JP-A-4-268552, European Patent 588,289, European Patent 591,934 and JP-A-6-208213 as a bleaching agent to increase the biodegradability of the bleaching agent. The concentration of the bleaching agent is preferably 0.05 to 0.3 mol per liter of the solution having a bleaching power. Preferably, the concentration is set to 0.1 to 0.15 mol in order to reduce the discharge amount to environments. If the solution having a bleaching power is a bleaching solution, it is desirable that the solution contain the bromide ions at a concentration of 0.2 to 1 mol, preferably 0.3 to 0.8 mol, per liter of the solution.

The replenisher solution of the solution having a bleaching power needs to have concentrations of the components shown below which are basically calculated by the following equation. As a result, the concentration in the mother solution can be maintained at a constant value.

$$C_R = C_T \times (V_1 + V_2)/V_1 + C_p$$

where $C_R$: Concentration of the component in the replenisher solution;

$C_T$: Concentration of the component in the mother solution (solution in the processing tank)

$C_p$: Concentration of the component consumed during the processing;

$V_1$: Quantity (mL) of replenisher solution having a bleaching power per $m^2$ of the light-sensitive material; and $V_2$: Quantity (mL) carried over from the preceding bath per $m^2$ of the light-sensitive material.

Further, it is preferable that the bleaching solution contain a pH buffering agent, preferred examples of which are low-odor dicarboxylic acids such as succinic acid, maleic acid, malonic acid, glutaric acid and adipic acid. It is also preferable to use known bleaching accelerators described in JP-A-53-95630, RD No. 17,129 and U.S. Pat. No. 3,893,858.

It is desirable that the bleaching solution be supplied with 50 to 1,000 mL, preferably 80 to 500 mL, and most preferably 100 to 300 mL of a replenisher solution of the bleaching solution per $m^2$ of the light-sensitive material. Further, it is preferable that the bleaching solution be aerated.

The compounds or processing conditions, which are described in JP-A-4-125558, page 7, lower left column, line 10 to page 8, lower right column, line 19, can be applied to the processing solution having a fixing power of the present invention.

In particular, in order to increase the fixing speed and the preservability of the solution, the solution having a fixing power preferably contains the compounds represented by the Formulas (I) and (II) in JP-A-6-301169 singly or as a combination. In addition, from the viewpoint of the enhancement of the preservability, it is preferable to use a sulfinic acid, such as p-toluenesulfinic acid salt, described in JP-A-1-224762.

When viewed from the enhancement of the desilvering capability, it is desirable that the solution having a bleaching power or a fixing power contain ammonium as a cation. However, it is preferable to decrease the ammonium content of the solution or to make the solution ammonium-free from the viewpoint of the reduction of the environmental pollution.

It is particularly preferable to carry out the jet-agitation of the solution described in JP-A-1-309059 at the steps of bleaching, bleach-fixing and fixing.

The quantity of replenisher at a bleach-fixing step or fixing step is 100 to 1,000 mL, preferably 150 to 700 mL, and most preferably 200 to 600 mL per $m^2$ of the light-sensitive material.

Preferably, the bleach-fixing step or fixing step is provided with an in-line or off-line silver recovery unit so that the silver is recovered. If an in-line unit is used, the quantity of replenisher can be reduced, because the silver concentration in the solution in the bath becomes smaller owing to the treatment. Meanwhile, it is also desirable to remove the silver by means of an off-line unit so that the residual solution is re-used as a replenisher solution.

The bleach-fixing step or fixing step may comprises a plurality of processing tanks, which are preferably arranged by a multistage counter-current method employing cascade piping. Because of the balance with the size of the processor, in general a two-tank cascade structure is efficient wherein the ratio of the processing time between the fore tank and the rear tank is preferably in the range of 0.5:1 to 1:0.5 and particularly preferably in the range of 0.8:1 to 1:0.8.

From the viewpoint of increasing the preservability, the bleach-fixing solution or fixing solution preferably contains a free chelating agent which is not in the form of a complex with a metal. These chelating agents are preferably biodegradable chelating agents previously described in connection with the bleaching solution.

The techniques described in JP-A-4-125558, page 12, lower right column, line 6 to page 13, lower right column, line 16 can be preferably applied to the water-washing and stabilizing step. Particularly, in order to preserve the acceptable working environments, it is preferable to incorporate the stabilizing solution with an azolylmethylamine described in European Patents 504,609 and 519,190 or an N-methylolazole described in JP-A-4-362943 as formaldehyde substitute compounds and to make the magenta coupler bi-equivalent for the purpose of utilizing a solution of a surface active agent free of a formaldehyde-based image stabilizer.

Meanwhile, in order to reduce the amount of dusts adhering to the magnetic recording layer coated on the light-sensitive material, the stabilizing solution described in JP-A-6-289559 may be preferably used.

The quantity of replenisher of washing water or of the stabilizing solution is 80 to 1,000 mL, preferably 100 to 500 mL, and most preferably 150 to 300 mL per $m^2$ of the light-sensitive material both from securing the water-washing or stabilizing function and from the reduction of waste solution in view of the environmental preservation. In the processing which is performed with the above-mentioned quantity of replenisher, it is preferable to use a known mildewproofing agent, such as thiabendazole, 1,2-benzoisothiazoline-3-on or 5-chloro-2-methylisothiazoline-3-on, an antibiotic, such as gentamycin, and deionized water which has been deionization-treated with an ion-exchange resin in order to prevent the growth of bacteria or mildew. The use of a combination of deionized water with an anti-bacteria agent or an antibiotic is more effective.

Further, it is desirable to reduce the amount of replenisher by the implementation of the reverse osmosis of the liquid inside the water-washing or stabilizing solution tank as described in JP-A-3-46652, JP-A-3-53246, JP-A-3-55542, JP-A-3-121448 and JP-A-3-126030. In this case, the reverse osmosis membrane is preferably a low-pressure reverse osmosis membrane.

In the processing of the present invention, it is particularly preferable to compensate for the evaporation of the processing solutions in accordance with the method described in Journal of Technical Disclosure No. 94-4992 of The Japan Institution of Innovation and Invention (hereinafter abbreviated as JIII). In particular, it is desirable to compensate for the evaporation based on the Equation (1) on page 2 by use of the temperature and humidity information in the environment where the processor is placed. The water to be used to compensate for evaporation is preferably taken from a replenishment tank to the water-washing bath, and the replenishing water is preferably deionized water.

The processing agents described in the above-mentioned Journal of Technical Disclosure, page 3, right column, line 15 to page 4, left column, line 32 are desirable for use in the present invention. A desirable processor using these processing agents is the film processor described in the above-mentioned Journal of Technical Disclosure, page 3, right column, lines 22 to 28.

Concrete examples of the desirable processing agents, automatic processors and methods for compensating for evaporation are described in the above-mentioned Journal of Technical Disclosure, page 5, right column, line 11 to page 7, right column, final line.

The supply form of a processing agent to be used in the present invention can be any of a liquid having the concentration of a solution in use, a concentrated liquid, a granule, a powder, a pellet, a paste and an emulsion. Examples of these processing agents are a liquid contained in a low-oxygen-permeability vessel disclosed in JP-A-63-17453, vacuum-packaged powders or granules disclosed in JP-A-4-19655 and JP-A-4-230748, granules containing a water-soluble polymer disclosed in JP-A-4-221951, pellets disclosed in JP-A-51-61837 and JP-A-6-102628, and a processing agent in the form of a paste disclosed in PCT National Publication No. 57-500485. Any of these forms can be preferably used. However, in respect of simplicity in use, the use of a liquid already prepared to have a concentration in use is preferable.

The material of vessels containing these processing agents can be any of polyethylene, polypropylene, polyvinylchloride, polyethylene terephthalate and nylon. These materials can be used singly or in the form of a composite material. These materials are so selected as to meet the level of a necessary oxygen permeability. Low-oxygen-permeability materials are suited to a solution such as a color developing solution which is readily oxidized. Practical examples are polyethylene terephthalate and a composite material of polyethylene and nylon. The thickness of a vessel made from any of these materials is 500 to 1,500 $\mu$m. The oxygen permeability is preferably 20 $mL/m^2 \cdot 24$ hrs·atm or less.

The processing solution for the color reversal film to be used in the present invention is described below. The detail of the processing technique for a color reversal film is described in Journal of Known Technologies No. 6 (Apr. 1, 1991, issued from ASTECH Co., Ltd.), page 1, line 5 to page 10, line 5 and page 15, line 8 to page 24, line 2. Any of these techniques can be preferably used in the present invention.

In the processing of the color reversal film, the control bath or the final bath contains the image stabilizing agent. Among examples of these image stabilizing agents which are formalin, sodium formaldehydebisulfite and an N-methylolazole, preferable is sodium formaldehydebisulfite or an N-methylolazole, N-methyloltriazole in particular, from the viewpoint of working environments. Further, the techniques, which were stated previously concerning the color developing solution, bleaching solution, fixing solution and washing water for the processing of color negative film, can also be preferably used for the processing of the color reversal film.

On the basis of the above description, preferred processing agents for color reversal films include E-6 Processing Agent manufactured by Eastman Kodak Co., Ltd. and CR-56 Processing Agent manufactured by Fuji Film Co., Ltd.

The color light-sensitive material to be used in the present invention preferably has a magnetic recording layer.

The magnetic recording layer is formed by coating the surface of a support with an aqueous or organic solvent-based coating solution which is prepared by dispersing magnetic grains in a binder.

The magnetic grains for use in the present invention can be ferromagnetic iron oxide such as $\gamma$ $Fe_2O_3$, Co-deposited $\gamma$ $Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite and Ca ferrite. Co-deposited ferromagnetic iron oxide such as Co-deposited $\gamma$ $Fe_2O_3$ is preferable. The grain can take the shape of any of, e.g., a needle, a rice grain, a sphere, a cube and a plate. A specific surface area is preferably 20 $m^2/g$ or more, and more preferably 30 $m^2/g$ or more as $S_{BET}$. The saturation magnetization ($\sigma s$) of the ferromagnetic substance is preferably $3.0\times10^4$ to $3.0\times10^5$ A/m, and most preferably $4.0\times10^4$ to $2.5\times10^5$ A/m. A surface treatment can be performed for the ferromagnetic grains by use of silica and/or alumina or an organic material. Also, the surface of the ferromagnetic grains can be treated with a silane coupling agent or a titanium coupling agent as described in JP-A-6-161032. Ferromagnetic grains, whose surface is coated with an inorganic or organic substance, described in JP-A-4-259911 and JP-A-5-81652 can also be used.

As the binder used together with the magnetic grains, it is possible to use a thermoplastic resin, a thermosetting resin, a radiation-curable resin, a reactive resin, an acid-, alkali- or bio-degradable polymer, a natural polymer (e.g., a cellulose derivative and a sugar derivative) and their mixtures described in JP-A-4-219569. Tg of the resin is −40° C. to 300° C., and its weight average molecular weight is 2,000 to 1,000,000. Examples of the resin are vinyl copolymers, cellulose derivatives, such as cellulose diacetate, cellulose triacetate, cellulose acetatepropionate, cellulose acetatebutylate and cellulose tripropionate, an acrylic resin, and a polyvinylacetal resin. Gelatin is also preferable. Cellulose di(tri)acetate is particularly preferable. The binder can be hardened by the addition of an epoxy, aziridine, or isocyanate crosslinking agent. Examples of the isocyanate crosslinking agent include isocyantes, such as tolylenediisocyanate, 4,4'-diphenylmethanediisocyanate, hexamethylenediisocyanate and xylylenediisocyanate, reaction products of these isocyanates and polyalcohols (e.g., a reaction product of 3 mols of tolylenediisocyanate and 1 mol of trimethylolpropane), and a polyisocyanate produced by condensation of any of these isocyanates. These examples are described in, e.g., JP-A-6-59357.

As a method for dispersing the magnetic substance in the binder, as described in JP-A-6-35092, the use of a kneader, a pin-type mill or an annular mill is preferable, and a combination of them is also preferable. Dispersants described in JP-A-5-088283 and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 g/m$^2$, preferably 0.01 to 2 g/m$^2$, and more preferably 0.02 to 0.5 g/m$^2$. The transmission yellow density of the magnetic recording layer is preferably 0.01 to 0.50, more preferably 0.03 to 0.20, and most preferably 0.04 to 0.15. The magnetic recording layer can be formed in the whole area of, or in the shape of stripes on, the back surface of a photographic support by coating or printing. The magnetic recording layer can be formed by any coating method using, e.g., an air doctor, a blade, an air knife, squeezing, impregnation, a reverse roll, a transfer roll, gravure, kissing, casting, spray, dipping, a bar or extrusion. A coating solution described in JP-A-5-341436 is preferable.

The magnetic recording layer may have additional functions such as improvement of lubricating property, adjustment of curling, electrostatic charge prevention, adhesion prevention and polish of head. Alternatively, an additional functional layer may be formed which performs these functions. A preferable polishing agent contains at least one type of aspherical inorganic grains which have a Mohs hardness of 5 or more. The composition of the aspherical inorganic grain is preferably an oxide, such as aluminum oxide, chromium oxide, silicon dioxide and titanium dioxide, a carbide, such as silicon carbide and titanium carbide, or a fine powder of diamond. The surfaces of the grains constituting these polishing agents can be treated with a silane coupling agent or a titanium coupling agent. These grains can be added to the magnetic recording layer, or the magnetic recording layer can be over-coated with a layer containing these grains (e.g., as a protective layer or a lubricating layer). The binder to be used together with the grains can be of any of those described above and is preferably the same binder as in the magnetic recording layer. Light-sensitive materials having the magnetic recording layer are described in U.S. Pat. No. 5,336,589; 5,250,404; 5,229,259 and 5,215,874, and European Patent 466,130.

A polyester support to be used in the present invention is described below. Details of the polyester support, light-sensitive materials, treatments, cartridges and examples are described in Journal of Technical Disclosure No. 94-6,023 (JIII; Mar. 15, 1994). The polyester used in the present invention is made up of a diol and an aromatic dicarboxylic acid as essential components. Examples of the aromatic dicarboxylic acid include 2,6-, 1,5-, 1,4- and 2,7-naphthalenedicarboxylic acids, terephthalic acid, isophthalic acid and phthalic acid. Examples of the diol include diethyleneglycol, triethyleneglycol, cyclohexanedimethanol, bisphenol A and bisphenol. Examples of the polymer are homopolymers such as polyethylene terephthalate, polyethylene naphthalate and polycyclohexanedimethanol terephthalate. The polyester containing 50 to 100 mol % of 2,6-naphthalenedicarboxylic acid is particularly preferable. Polyethylene 2,6-naphthalate is most preferable among these polymers. The average molecular weight ranges between 5,000 and 200,000. Tg of the polyesters for use in the present invention is 50° C. or higher, preferably 90° C. or higher.

In order to make the polyester support more resistant to curling, the polyester support is heat-treated at a temperature within the range of from 40° C. to less than Tg, more preferably at a temperature within the range of from Tg-20° C. to less than Tg. The heat treatment can be performed at a fixed temperature within this range or can be performed together with cooling. The heat treatment time is 0.1 to 1,500 hours, more preferably 0.5 to 200 hours. The heat treatment can be performed for a roll-like support or while the support is conveyed in the form of a web. Fine undulations (e.g., coating the surface with electro-conductive inorganic fine grains such as $SnO_2$ or $Sb_2O_5$) may be given to the surface to improve the surface condition. It is also desirable to knurl and slightly raise the end portion, thereby preventing the cut portion of the core from being photographed. These heat treatments can be performed at any stage, for example, after support film formation, after surface treatment, after back layer coating (e.g., an antistatic agent or lubrication agent) and after the application of an undercoat. A preferable timing for the heat treatment is after the application of the antistatic agent.

An ultraviolet absorbent may be incorporated into this polyester. Also, the prevention of light piping can be achieved by incorporating the polyester with a dye or pigment, such as Diaresin manufactured by Mitsubishi Chemical Industries, Ltd. or Kayaset manufactured by Nippon Kayaku Co., Ltd., which is commercially available as an additive to polyester.

In the present invention, it is preferable to perform a surface treatment of the support in order to increase the bonding strength between the support and the light-sensitive material constituting layers. Examples of the surface treatment are surface activating treatments which include a chemical treatment, a mechanical treatment, a corona discharge treatment, a flame treatment, an ultraviolet treatment, a high-frequency treatment, a glow discharge treatment, an active plasma treatment, a laser treatment, a mixed acid treatment and an ozone oxidation treatment. Preferred surface treatments are the ultraviolet irradiation treatment, the flame treatment, the corona treatment and the glow treatment.

The undercoat may consist of a single layer or two or more layers. Examples of the binder for the undercoat layer include a copolymer produced by using, as a starting material, a monomer selected from the group consisting of vinyl chloride, vinylidene chloride, butadiene, methacrylic acid, acrylic acid, itaconic acid, maleic anhydride and the like. Other examples include polyethyleneimine, an epoxy resin, grafted gelatin, nitrocellulose and gelatin. Resorcin and p-chlorophenol are examples of a compound which swells the support. Examples of a gelatin hardener to be added to the undercoat layer include chromium salts (e.g., chromium alum), aldehydes (e.g., formaldehyde and glutaraldehyde), isocyanates, active halogenated compounds (e.g., 2,4-dichloro-6-hydroxy-s-triazine), epichlorohydrin resins and active vinylsulfones. The undercoat layer may contain $SiO_2$, $TiO_2$, inorganic fine grains or fine grains of a polymethyl methacrylate copolymer (0.01 to 10 μm) as a matting agent.

In the present invention, an antistatic agent is preferably used. Examples of the antistatic agent include polymers containing carboxylic acid group, carboxylate group, or a sulfonate group, cationic polymers and ionic surfactant compounds.

It is most preferable to use as the antistatic agent at least one finely-divided crystalline metal oxide which is selected from the group consisting of ZnO, $TiO_2$, $SnO_2$, $Al_2O_3$, $In_2O_3$, $SiO_2$, MgO, BaO, $MoO_3$ and $V_2O_5$ and which has a volume resistivity of $10^7$ Ω·cm or less, more preferably $10^5$ Ω·cm or less, and a grain size of 0.001 to 1.0 μm, fine grains of composite oxides (e.g., Sb, P, B, In, S, Si and C) of these metal oxides, fine grains of sol metal oxides, or fine grains of composite oxides of these sol metal oxides. The content in the light-sensitive material is preferably 5 to 500 mg/m$^2$, and most preferably 10 to 350 mg/m$^2$. The weight ratio of an electroconductive crystalline oxide or its composite oxide to the binder is preferably 1/300 to 100/1, and more preferably 1/100 to 100/5.

The light-sensitive material of the present invention preferably has a slip property. Slip agent-containing layers are preferably formed on the surfaces of both a light-sensitive layer and a back layer. A preferable slip property is indicated by a coefficient of kinetic friction of 0.01 to 0.25. This value represents the value that is obtained when a sample is conveyed at a speed of 60 cm/min. while keeping contact with a stainless steel ball having a diameter of 5 mm (25° C., 60% RH). In this evaluation, a value of nearly the same level is obtained even when the stainless steel ball is replaced with the surface of a light-sensitive layer.

Examples of the slip agent usable in the present invention are polyorganosiloxanes, higher fatty acid amides, metals salts of higher fatty acids, and esters of higher fatty acids and higher alcohols. Examples of the polyorganosiloxanes include polydimethylsiloxane, polydiethylsiloxane, polystyrylmethylsiloxane and polymethylphenylsiloxane. A layer to which the slip agent is added is preferably the outermost emulsion layer or the back layer. Polydimethylsiloxanes or esters having a long-chain alkyl group are particularly preferable.

The light-sensitive material of the present invention preferably contains a matting agent. Although the matting agent can be added to either the emulsion surface or the back surface, it is most preferably added to the outermost layer on the side having the emulsion layer. The matting agent can be either soluble or insoluble in the processing solutions, and the use of a combination of both types of the matting agents is preferable. Preferable examples are polymethylmethacrylate grains, poly(methylmethacrylate/methacrylic acid=9/1 or 5/5 (molar ratio)) grains and polystyrene grains. The grain size is preferably 0.8 to 10 μm, and a narrow grain size distribution is preferable. It is preferable that 90% or more by number of all of the grains have grain sizes of 0.9 to 1.1 times the average grain size. To increase the matting effect, it is preferable to simultaneously add fine grains having a grain size of 0.8 μm or less, examples of which include polymethylmethacrylate grains (0.2 μm), poly (methylmethacrylate/methacrylic acid=9/1 (molar ratio)) grains (0.3 μm), polystyrene grains (0.25 μm) and colloidal silica (0.03 μm).

A film cartridge to be used in the present invention is described below. The principal material of the cartridge to be used in the present invention can be a metal or synthetic plastic.

Examples of preferable plastic materials include polystyrene, polyethylene, polypropylene and polyphenylene ether. The cartridge of the present invention can also contain various antistatic agents. For this purpose, carbon black, metal oxide grains, nonionic, anionic, cationic or betaine surfactants, or polymers can be preferably used. These cartridges subjected to the antistatic treatment are described in JP-A-1-312537 and JP-A-1-312538. It is particularly preferable that the resistance be $10^{12}$ Ω or less at 25° C. and 25% RH. Commonly, plastic cartridges are manufactured by using plastics into which carbon black or pigments are incorporated to give a light-shielding property. The cartridge size can be a presently available 135 size. For the purpose of down-sizing the cameras, it is effective to decrease the diameter of a 25-mm cartridge of 135 size to 22 mm or less. The volume of a cartridge case is 30 cm$^3$ or less, preferably 25 cm$^3$ or less. The weight of the plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films to be used in the present invention can be so-called raw films before being developed or developed photographic films. Also, raw and developed photographic films can be accommodated in the same new cartridge or in different cartridges.

EXAMPLES

The present invention will be described in more detail below by way of its examples. However, the present invention is not limited to these examples as long as the invention does not depart from the gist of the invention.

Example 1

1) Support

A support used in this example was formed as follows.

100 parts by weight of a polyethylene-2,6-naphthalate (PEN) polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 seconds. The result was a 90 μm-thick PEN film. Note that this PEN film was added with proper amounts of blue, magenta and yellow dyes (I-1, I-4, I-6, I-24, I-26, I-27 and II-5 described in Journal of Technical Disclosure No. 94-6,023). The PEN film was wound around a stainless steel core having a diameter of 20 cm and given a thermal history of 48 hours at 110° C., thereby manufacturing a support with a high resistance to curling.

2) Corting of Undercoat Layers

The two surfaces of the support were subjected to corona discharge, UV irradiation and glow discharge and thereafter coated with an undercoat solution (10 cc/m$^2$, by using a bar coater), consisting of 0.1 g/m$^2$ of gelatin, 0.01 g/m$^2$ of sodium-α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of a polyamide/epichlorohydrin polycondensate, forming undercoat layers on sides at a higher temperature upon orientation. Drying was performed at 115° C. for 6 min. (all rollers and conveyors in the drying zone were at 115° C.).

3) Corting of Back Layers

On one surface of the undercoated support, an antistatic layer, a magnetic recording layer and a slip layer having the following compositions were coated as back layers.

3-1) Corting of Antistatic Layer 0.2 g/m$^2$ of a dispersion (secondary aggregate grain size =about 0.08 μm) of a fine-grain powder, having a specific resistance of 5 Ω·cm, of a tin oxide-antimony oxide composite material with an average grain size of 0.005 μm was coated together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol(polymerization degree 10) and resorcin.

3-2) Coating of Magnetic Recording Layer 0.06 g/m$^2$ of cobalt-γ-iron oxide (specific surface area 43 m$^2$/g; major axis 0.14 μm, minor axis 0.03 μm, saturation magnetization 89 emu/g, $Fe^{+2}/Fe^{+3}$=6/94; surface was treated with 2 wt % of ion oxide by aluminum oxide/silicon oxide coated with in an amount corresponding to 2 wt % of the iron oxide) coated with 3-polyoxyethylene-propyloxytrimethoxysilane (polymerization degree 15, 15 wt %) was coated by a bar coater together with 1.2 g/m$^2$ of diacetylcellulose (iron oxide was dispersed by an open kneader and a sand mill) by using 0.3 g/m$^2$ of $C_2H_5C(CH_2OCONH{-}C_6H_3(CH_3)NCO)_3$ as a hardener and acetone, methylethylketone and cyclohexanone as solvents, forming a 1.2 μm-thick magnetic recording layer. 10 mg/m$^2$ of silica grains (0.3 μm) as a matting agent, and 10 mg/m$^2$ of aluminum oxide grains (0.15 μm) coated with 3-polyoxyethylene-propyloxytrimethoxysilane (polymerization degree 15, 15 wt %) were added as a polishing agent. Drying was performed at 115° C. for 6 min. (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, 7.3×10$^4$ A/m and 65%, respectively.

3-3) Preparation of a Slip Layer

Diacetylcellulose (25 mg/m$^2$) and a mixture of $C_6H_{13}CH(OH)C_{10}H_{20}COOC_{40}H_{81}$(compound a, 6 mg/m$^2$)/$C_{50}H_{101}O(CH_2CH_2O)_{16}H$ (compound b, 9 mg/m$^2$) were coated. Note that this mixture was melted in xylene/propylenemonoglycolmonomethylether (1/1) at 105° C., dispersed in propylenemonoglycolmonomethylether (tenfold amount) of room temperature, and formed into a dispersion (average grain size 0.01 μm) in acetone before being added. 15 mg/m$^2$ of silica grains (0.3 μm) were added as a matting agent, and 15 mg/m$^2$ of 3-polyoxyethylene-propyloxytrimethoxysilane (polymerization degree 15, aluminum oxide coated by 15 wt %, 0.15 μm) were added as polishing agent. Drying was performed at 115° C. for 6 min. (all rollers and conveyors in the drying zone were at 115° C.). The resultant slip layer was found to have excellent characteristics. That is, the coefficient of kinetic friction was 0.06 (5 mmϕ stainless steel hard sphere, load 100 g, speed 60 cm/min) and the coefficient of static friction was 0.07 (clip method). The coefficient of kinetic friction between an emulsion surface (to be described later) and the slip layer was also excellent, 0.12.

4) Coating of Light-Sensitive Layers

On the side away from the back layers formed as above, a plurality of layers having the following compositions were coated to prepare sample 101 as a multilayered color negative film.

(Preparation of Sample 101)

(Compositions of Light-Sensitive Layers)

The main materials used in the individual layers were classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |
| ExS: Sensitizing dye | |

The number corresponding to each component indicates the coating amount in units of g/m$^2$. The coating amount of a silver halide is represented by the amount of silver. The coating amount of each sensitizing dye is represented in units of mol per mol of a silver halide in the same layer.

(Sample 101)

| | | |
|---|---|---|
| 1st layer (1st antihalation layer) | | |
| Black colloidal silver | silver | 0.08 |
| Gelatin | | 0.70 |
| 2nd layer (2nd antihalation layer) | | |
| Black colloidal silver | silver | 0.09 |
| Gelatin | | 1.00 |
| ExM-1 | | 0.12 |
| ExF-1 | | 2.0 × 10$^{-3}$ |
| Solid dispersion dye ExF-2 | | 0.030 |
| Solid dispersion dye ExF-3 | | 0.040 |
| HBS-1 | | 0.15 |
| HBS-2 | | 0.02 |
| 3rd layer (Interlayer -1) | | |
| ExC-2 | | 0.05 |
| Polyethylacrylate latex | | 0.20 |
| Gelatin | | 0.70 |
| 4th layer (Low-speed red-sensitive emulsion layer) | | |
| Silver iodobromide emulsion A | silver | 0.20 |
| Silver iodobromide emulsion B | silver | 0.23 |
| Silver iodobromide emulsion C | silver | 0.10 |
| ExS-1 | | 3.8 × 10$^{-4}$ |
| ExS-2 | | 1.6 × 10$^{-5}$ |
| ExS-3 | | 5.2 × 10$^{-4}$ |
| ExC-1 | | 0.17 |
| ExC-2 | | 0.02 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 1.10 |
| 5th layer (Medium-speed red-sensitive emulsion layer) | | |
| Silver iodobromide emulsion C | silver | 0.15 |
| Silver iodobromide emulsion D | silver | 0.46 |
| ExS-1 | | 4.0 × 10$^{-4}$ |
| ExS-2 | | 2.1 × 10$^{-5}$ |
| ExS-3 | | 5.7 × 10$^{-4}$ |
| ExC-1 | | 0.14 |
| ExC-2 | | 0.02 |
| ExC-3 | | 0.03 |
| ExC-4 | | 0.090 |
| ExC-5 | | 0.02 |
| ExC-6 | | 0.01 |
| Cpd-4 | | 0.030 |

-continued

| | | |
|---|---|---|
| Cpd-2 | | 0.05 |
| HBS-1 | | 0.10 |
| Gelatin | | 0.75 |
| 6th layer (Highspeed red-sensitive emulsion layer) | | |
| Silver iodobromide emulsion E | silver | 1.30 |
| ExS-1 | | $2.5 \times 10^{-4}$ |
| ExS-2 | | $1.1 \times 10^{-5}$ |
| ExS-3 | | $3.6 \times 10^{-4}$ |
| ExC-1 | | 0.12 |
| ExC-3 | | 0.11 |
| ExC-6 | | 0.020 |
| ExC-7 | | 0.010 |
| Cpd-2 | | 0.050 |
| Cpd-4 | | 0.020 |
| HBS-1 | | 0.22 |
| HBS-2 | | 0.050 |
| Gelatin | | 1.40 |
| 7th layer (Interlayer-2) | | |
| Cpd-1 | | 0.060 |
| Solid dispersion dye ExF-4 | | 0.030 |
| HBS-1 | | 0.040 |
| Polyethylacrylate latex | | 0.15 |
| Gelatin | | 1.10 |
| 8th layer (Low-speed green-sensitive emulsion layer) | | |
| Silver iodobromide emulsion F | silver | 0.22 |
| Silver iodobromide emulsion G | silver | 0.35 |
| ExS-7 | | $1.4 \times 10^{-4}$ |
| ExS-8 | | $6.2 \times 10^{-4}$ |
| ExS-4 | | $2.7 \times 10^{-5}$ |
| ExS-5 | | $7.0 \times 10^{-5}$ |
| ExS-6 | | $2.7 \times 10^{-4}$ |
| ExM-3 | | 0.410 |
| ExM-4 | | 0.086 |
| ExY-1 | | 0.070 |
| ExY-5 | | 0.0070 |
| HBS-1 | | 0.30 |
| HBS-3 | | 0.015 |
| Cpd-4 | | 0.010 |
| Gelatin | | 0.95 |
| 9th layer (Medium-speed green-sensitive emulsion layer) | | |
| Silver iodobromide emulsion G | silver | 0.48 |
| Silver iodobromide emulsion H | silver | 0.48 |
| ExS-4 | | $4.8 \times 10^{-5}$ |
| ExS-7 | | $2.1 \times 10^{-4}$ |
| ExS-8 | | $9.3 \times 10^{-4}$ |
| ExC-8 | | 0.0020 |
| ExM-3 | | 0.115 |
| ExM-4 | | 0.035 |
| ExY-1 | | 0.010 |
| ExY-4 | | 0.010 |
| ExY-5 | | 0.0050 |
| Cpd-4 | | 0.011 |
| HBS-1 | | 0.13 |
| HBS-3 | | $4.4 \times 10^{-3}$ |
| Gelatin | | 0.80 |
| 10th layer (High-speed green-sensitive emulsion layer) | | |
| Silver iodobromide emulsion I | silver | 1.30 |
| ExS-4 | | $4.5 \times 10^{-5}$ |
| ExS-7 | | $1.2 \times 10^{-4}$ |
| ExS-8 | | $5.3 \times 10^{-4}$ |
| ExC-1 | | 0.021 |
| ExM-1 | | 0.010 |
| ExM-2 | | 0.030 |
| ExM-5 | | 0.0070 |
| ExM-6 | | 0.0050 |
| Cpd-3 | | 0.017 |
| Cpd-4 | | 0.040 |
| HBS-1 | | 0.25 |
| Polyethylacrylate latex | | 0.15 |
| Gelatin | | 1.33 |
| 11th layer (Yellow filter layer) | | |
| Yellow colloidal silver | silver | 0.015 |
| Cpd-1 | | 0.16 |

-continued

| | | |
|---|---|---|
| Solid dispersion dye ExF-5 | | 0.060 |
| Solid dispersion dye ExF-6 | | 0.060 |
| Oil-soluble dye ExF-7 | | 0.010 |
| HBS-1 | | 0.60 |
| Gelatin | | 0.60 |
| 12th layer (Low-speed blue-sensitive emulsion layer) | | |
| Silver iodobromide emulsion J | silver | 0.09 |
| Silver iodobromide emulsion K | silver | 0.10 |
| Silver iodobromide emulsion L | silver | 0.25 |
| ExS-9 | | $8.4 \times 10^{-4}$ |
| ExC-1 | | 0.03 |
| ExC-8 | | $7.0 \times 10^{-3}$ |
| ExY-1 | | 0.050 |
| ExY-2 | | 0.75 |
| ExY-3 | | 0.40 |
| ExY-4 | | 0.040 |
| Cpd-2 | | 0.10 |
| Cpd-4 | | 0.01 |
| Cpd-3 | | $4.0 \times 10^{-3}$ |
| HBS-1 | | 0.28 |
| Gelatin | | 2.10 |
| 13th layer (High-speed blue-sensitive emulsion layer) | | |
| Silver iodobromide emulsion M | silver | 0.58 |
| ExS-9 | | $3.5 \times 10^{-4}$ |
| ExY-2 | | 0.070 |
| ExY-3 | | 0.070 |
| ExY-4 | | 0.0050 |
| Cpd-2 | | 0.10 |
| Cpd-3 | | $1.0 \times 10^{-3}$ |
| Cpd-4 | | 0.02 |
| HBS-1 | | 0.075 |
| Gelatin | | 0.55 |
| 14th layer (1st protective layer) | | |
| Silver iodobromide emulsion N | silver | 0.10 |
| UV-1 | | 0.13 |
| UV-2 | | 0.10 |
| UV-3 | | 0.16 |
| UV-4 | | 0.025 |
| ExF-8 | | 0.001 |
| ExF-9 | | 0.002 |
| HBS-1 | | $5.0 \times 10^{-2}$ |
| HBS-4 | | $5.0 \times 10^{-2}$ |
| Gelatin | | 1.8 |
| 15th (2nd protective layer) | | |
| H-1 | | 0.40 |
| B-1(diameter: 1.7 $\mu$m) | | 0.04 |
| B-2(diameter: 1.7 $\mu$m) | | 0.09 |
| B-3 | | 0.13 |
| ES-1 | | 0.20 |
| Gelatin | | 0.70 |

In addition to the above components, to improve storage stability, processability, a resistance to pressure, antiseptic and mildewproofing properties, antistatic properties and coating properties, the individual layers contained W-1 to W-3, B-4 to B-6, F-1 to F-18, iron salt, lead salt, gold salt, platinum salt, palladium salt, iridium salt and rhodium salt.

The average AgI contents and grain sizes of the emulsions used for the preparation of the samples 101 are shown in the following Table 1.

TABLE 1

| Emulsion | Average AgI content (mol %) | Average grain size: equivalent-sphere diameter (μm) | Variation coefficient of grain diameter (%) | Diameter of projected area: equivalent-circle diameter (μm) | Diameter/ thickness ratio | Degree of tabularity |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 4.7 | 0.85 | 22 | 1.36 | 5.5 | 22 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 7.5 | 0.85 | 24 | 1.30 | 5.0 | 19 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.3 | 1.05 | 20 | 1.46 | 3.7 | 9 |
| N | 1.0 | 0.07 | — | — | 1.0 | — |
| O | 0.0 | 0.13 | 12 | 0.13 | 1.0 | — |
| P | 0.0 | 0.33 | 13 | 0.50 | 5.0 | 50 |

In Table 1, (1) The emulsions J to M were reductively sensitized by use of thiourea dioxide and thiosulfonic acid at the time of grain preparation according to the examples described in JP-A-2-191938.

(2) The emulsions C to E, emulsions G to I and emulsion M were gold-sensitized, sulfur-sensitized and selenium-sensitized in the presence of a spectrally sensitizing dye and sodium thiocyanate shown in the components of the individual light-sensitive layers according to the examples described in JP-A-3-237450.

(3) Low-molecular-weight gelatin was used for the preparation of tabular grains according to the examples described in JP-A-1-158426.

(4) Under a high-voltage electronic microscope, dislocation lines similar to those described in JP-A-3-237450 were observed on the tabular grains.

(5) The emulsions A to E, emulsions G and H, and emulsions J to M contain an optimal amounts of Rh, Ir and Fe. The tabularity is defined by $Dc/t^2$, where Dc represents an equivalent-circle average diameter of the projected area of a grain, and t represents the average thickness of tabular grains.

(Preparation of Dispersions of Organic Solid Dispersions Dyes)

ExF-2 was prepared by the following method. 21.7 mL of water, 3 mL of a 5% aqueous solution of p-octylphenoxyethoxyethanesulfonic acid soda, and 0.5 g of a 5% aqueous solution of p-octylphenoxypolyoxyethylene ether (polymerization degree: 10) were placed in a 700 mL pot mill, and 5.0 g of dye ExF-2 and 500 mL of zirconium oxide beads (diameter: 1 mm) were added to the mill. The contents were dispersed for 2 hours by using a BO-type vibration mill manufactured by Chuo Koki Co., Ltd. After the dispersing operation, the contents were taken out and were added to 8 g of a 12.5% aqueous gelatin solution. The beads were removed by filtration from the resultant material, thus obtaining a dispersion of the dye in gelatin. The average grain diameter of the finely-dispersed dye grains was 0.44 μm.

Following the same procedure as above, solid dispersions ExF-3, ExF-4 and ExF-6 were obtained. The average grain sizes of these finely-dispersed dye grains were 0.24 μm, 0.45 μm and 0.52 μm, respectively. ExF-5 was dispersed by a micorprecipitation dispersion method described in Example 1 of European Patent 549,489A. The average grain size was found to be 0.06 μm.

The compounds used in the formation of the layers in Sample 101 are as follows.

ExC-1

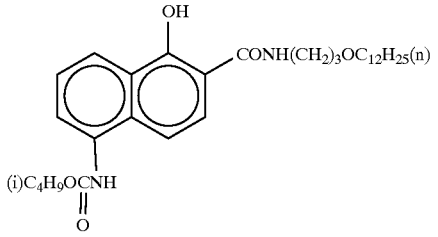

-continued
ExC-2
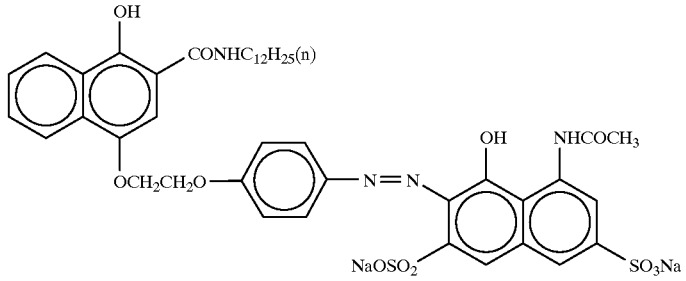
ExC-3
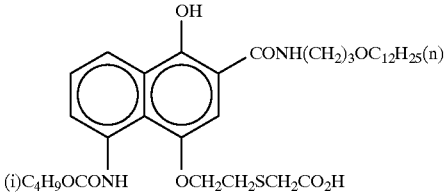
ExC-4
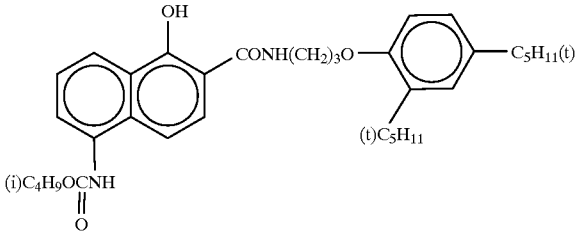
ExC-5
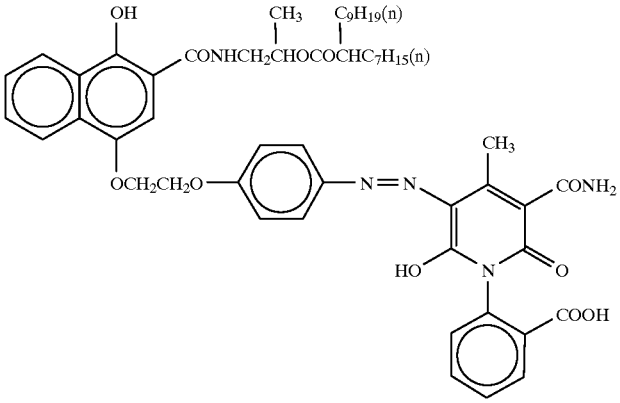
ExC-6
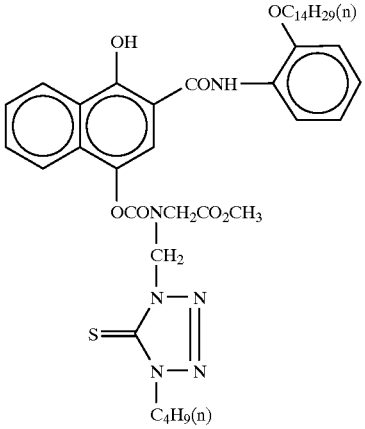

-continued
ExC-7
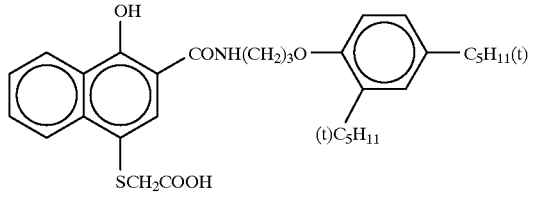
ExC-8
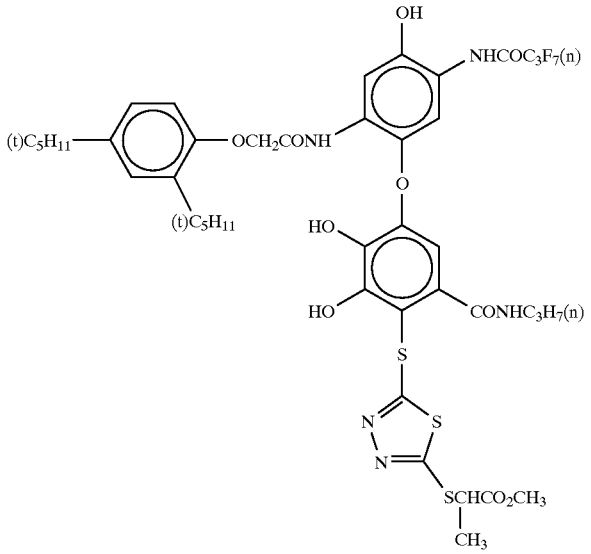
ExM-1
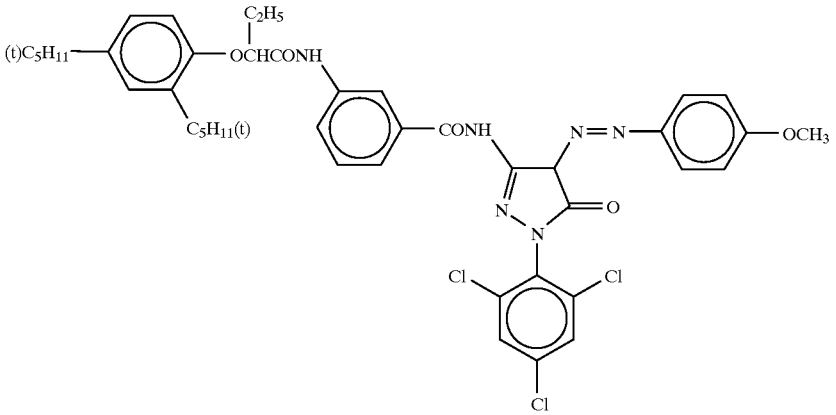
ExM-2
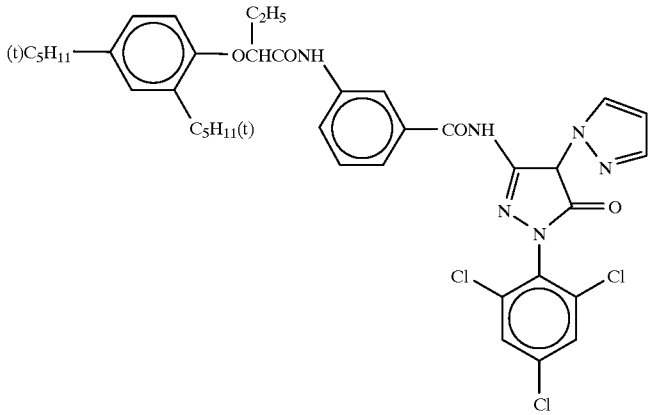

-continued
ExM-3
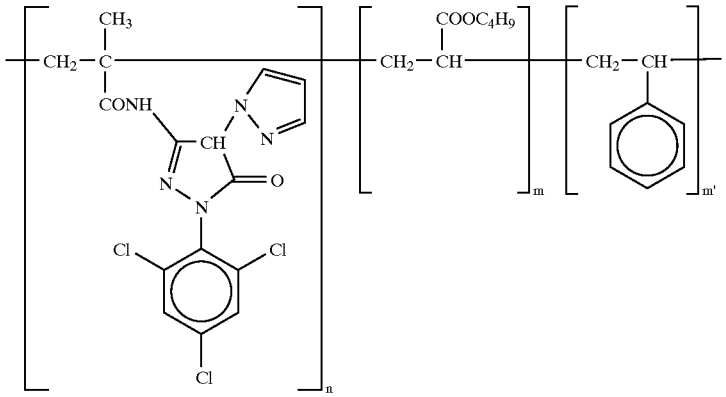
n = 50
m = 25
m' = 25
mol.wt. about 20,000
ExM-4
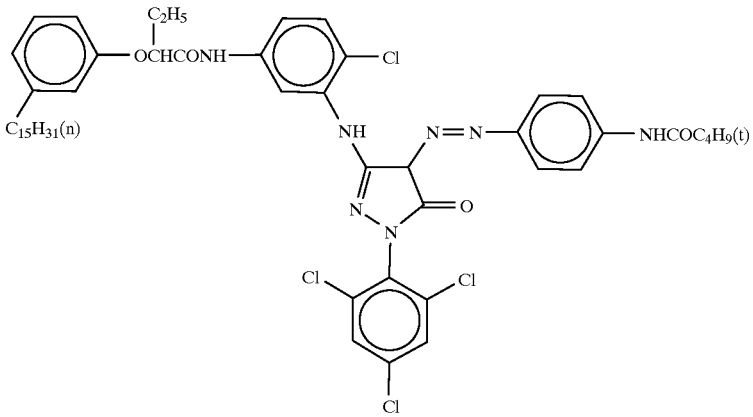
ExM-5
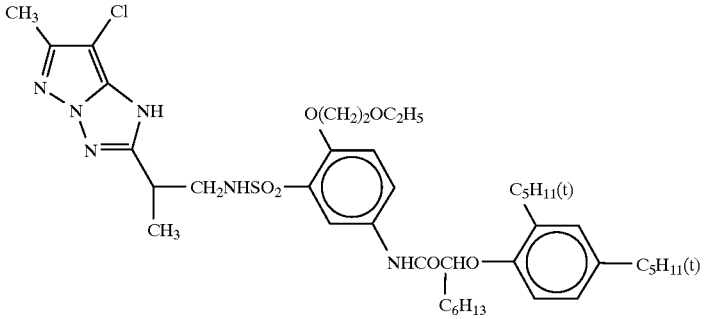
ExM-6
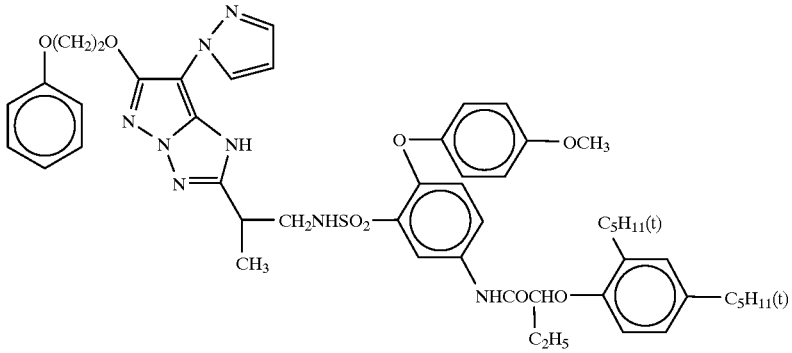

-continued
ExY-1
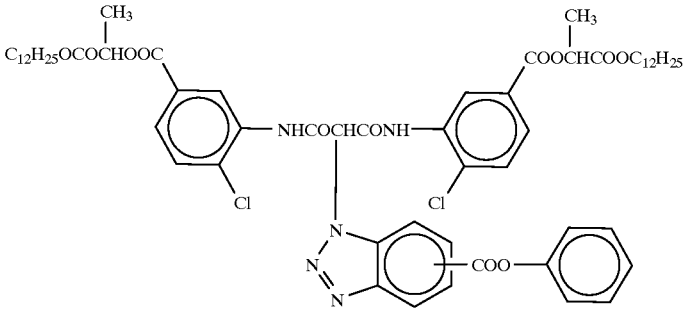
ExY-2
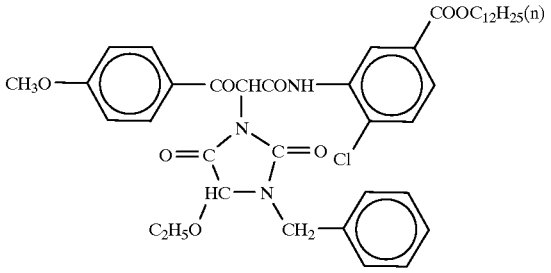
ExY-3
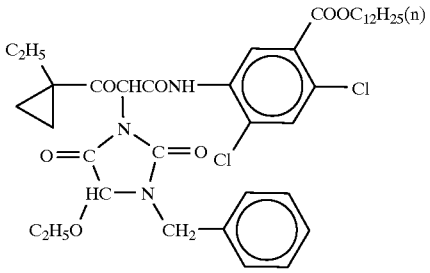
ExY-4
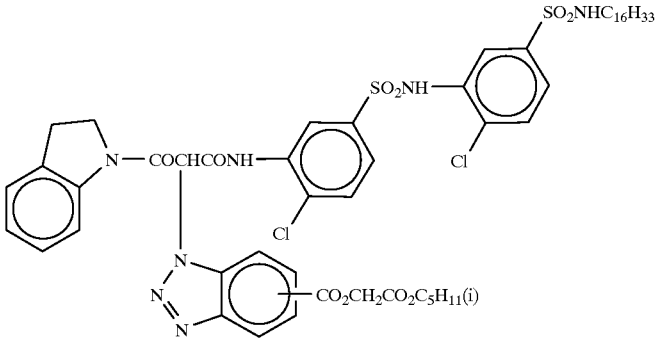
ExY-5
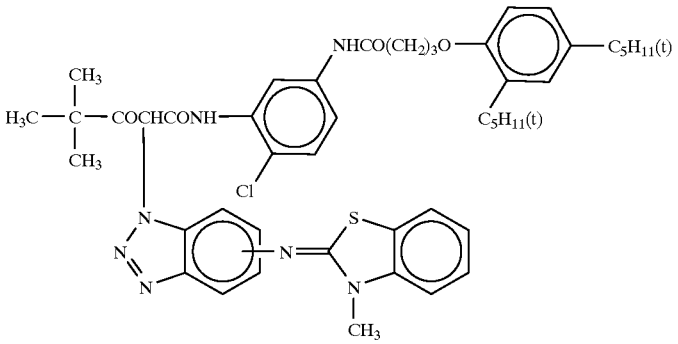

-continued
ExF-1
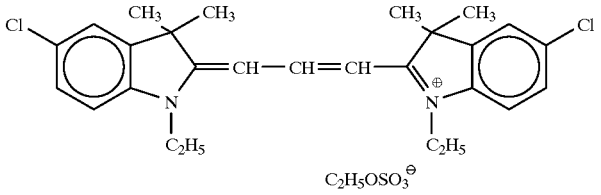
ExF-2
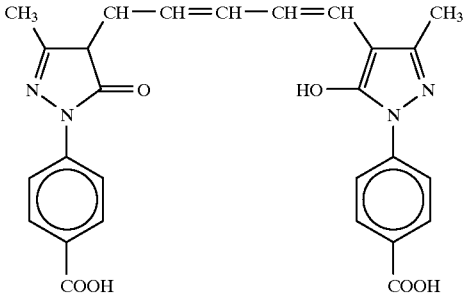
ExF-3
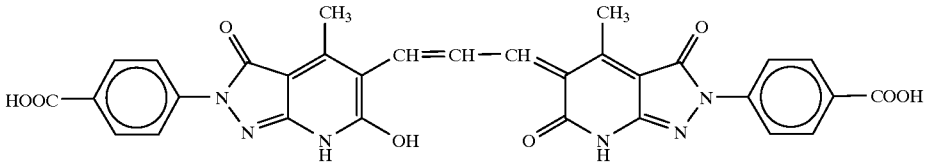
ExF-4
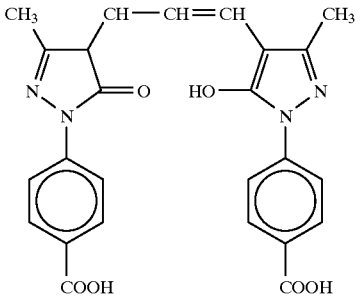
ExF-5
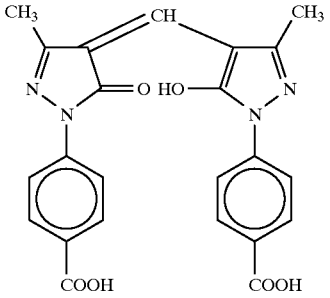
ExF-6
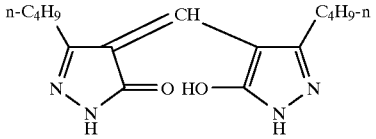

-continued
ExF-7
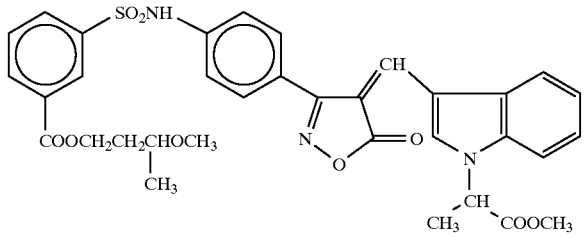
ExF-8
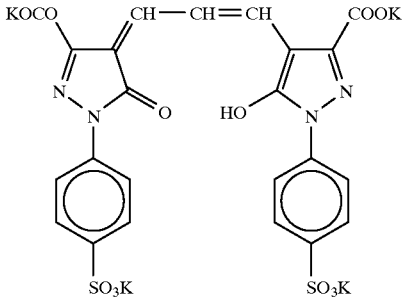
ExF-9
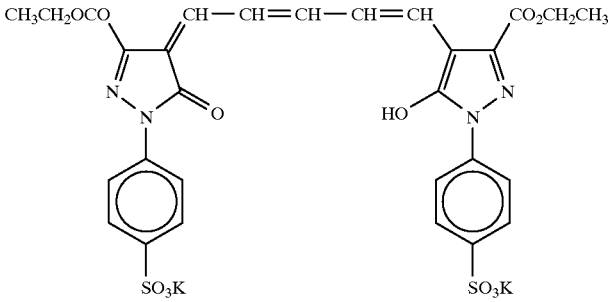
Cpd-1
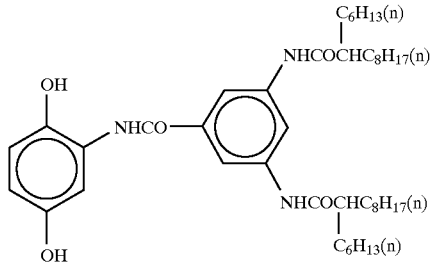
Cpd-2
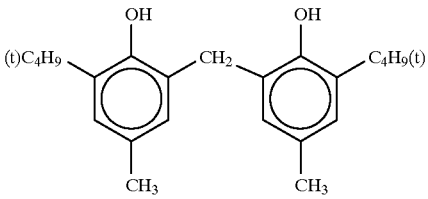
Cpd-3
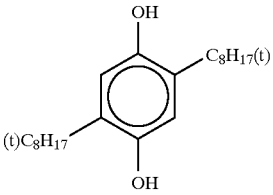

-continued
Cpd-4
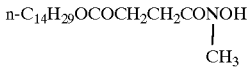
UV-1
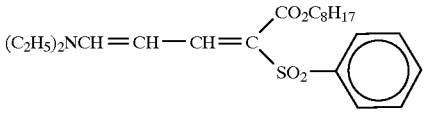
UV-2
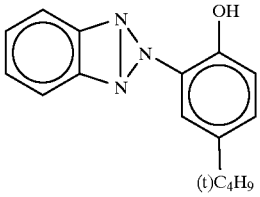
UV-3
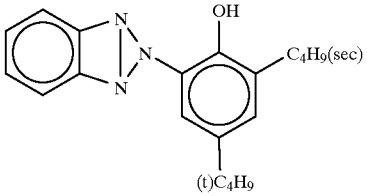
UV-4
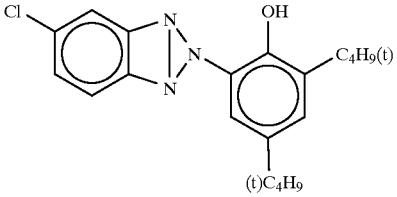
HBS-1
Tricresylphosphate
HBS-2
Di-n-butylphthalate
HBS-3
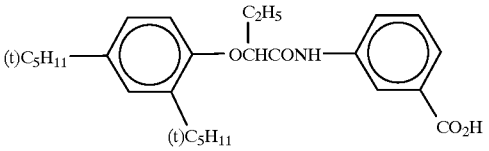
HBS-4
Tri (2-ethylhexyl) phosphate
ExS-1
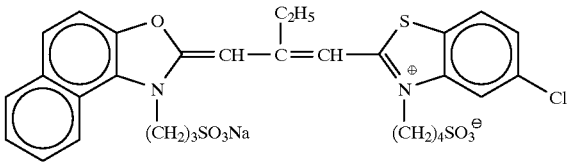
ExS-2
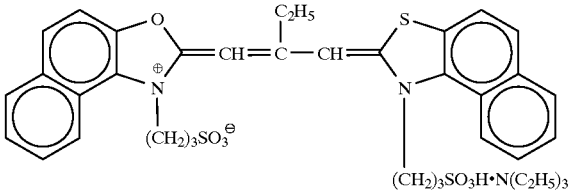

-continued
ExS-3
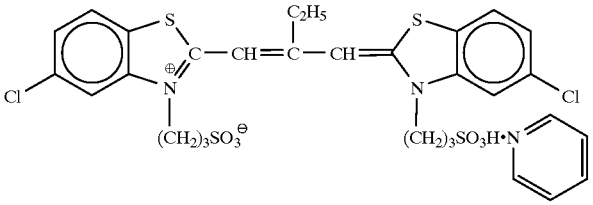
ExS-4
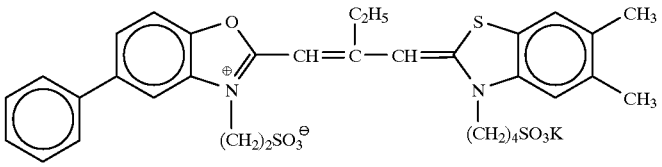
ExS-5
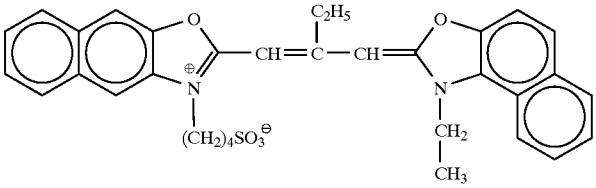
ExS-6
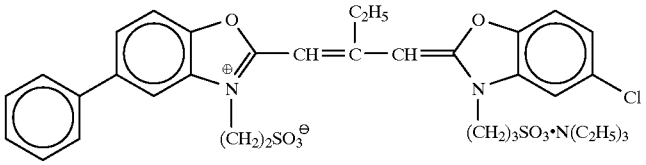
ExS-7
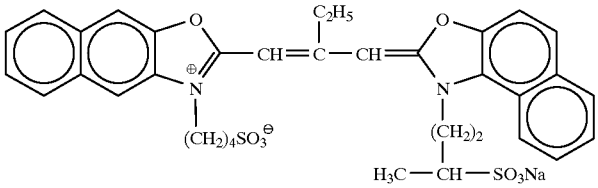
ExS-8
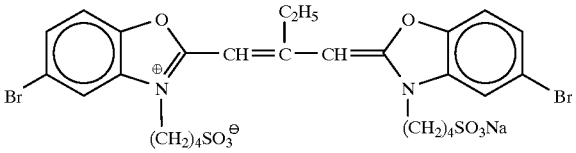
ExS-9
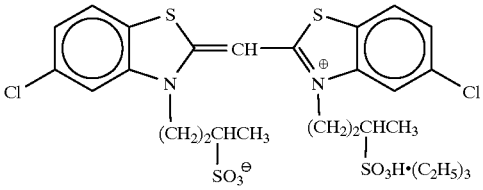
ES-1
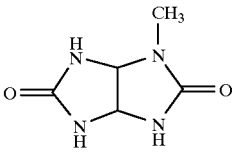

-continued
H-1
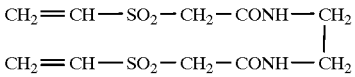
B-1
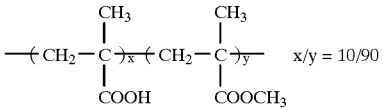
x/y = 10/90
average molecular weight: about 35,000
B-2
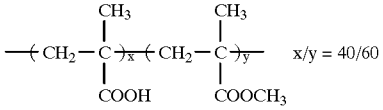
x/y = 40/60
average molecular weight: about 20,000
B-3
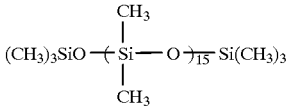
B-4
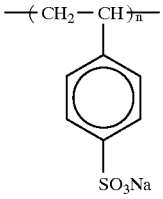
average molecular weight: about 750,000
B-5
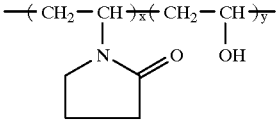
x/y = 70/30
average molecular weight: about 17,000
B-6
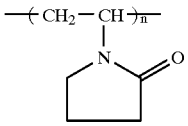
average molecular weight: about 10,000
W-1
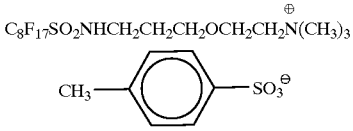
W-2
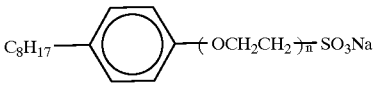
n = 2–4
W-3
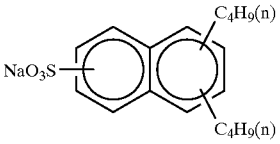

-continued
F-1
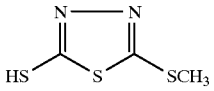
F-2
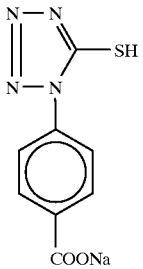
F-3
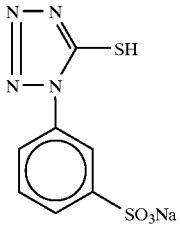
F-4
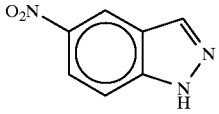
F-5
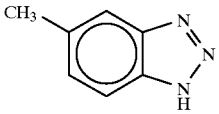
F-6
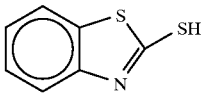
F-7
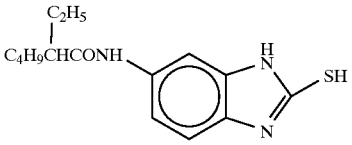
F-8
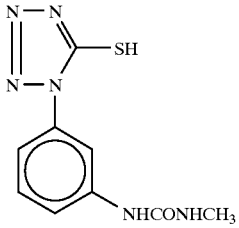
F-9
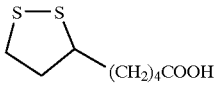

-continued

F-10

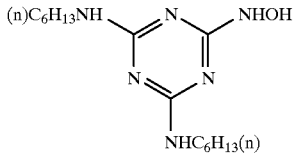

F-11

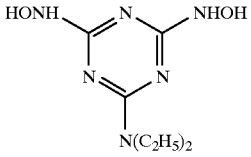

F-12

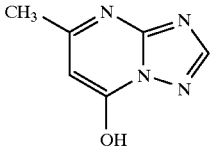

F-13

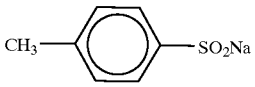

F-14

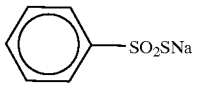

F-15

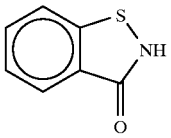

F-16

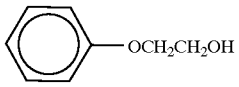

F-17

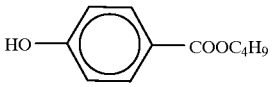

F-18

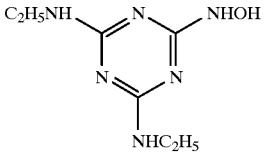

(Preparation of Sample 102)

Sample 102 was prepared following the same procedure as in the preparation of the sample 101 except that the 7th layer (interlayer-2), the 8th layer (low-speed green-sensitive emulsion layer), the 9th layer (medium-speed green-sensitive emulsion layer) and the 10th layer (high-speed green-sensitive emulsion layer) were omitted, and interlayer-3, low-speed white-sensitive layer-a, medium-speed white-sensitive layer-a and high-speed white-sensitive layer-a were formed between the high-speed blue-sensitive emulsion layer and the first protective layer. That is, the order of the layer formation from the support was the 1st antihalation layer/the 2nd antihalation layer/interlayer-1/low-speed red-sensitive emulsion layer/medium-speed red-sensitive emulsion layer/high-speed red-sensitive emulsion layer/yellow filter layer/low-speed blue-sensitive emulsion layer/high-speed blue-sensitive emulsion layer/interlayer-3/low-speed white-sensitive layer-a/medium-speed white-sensitive layer-a/high-speed white-sensitive layer-a/the 1st protective layer/the 2nd protective layer. The compositions of interlayer-3, low-speed white-sensitive layer-a, medium-speed white-sensitive layer-a and high-speed white-sensitive layer-a are shown below.

| | | |
|---|---|---|
| (Interlayer-3) | | |
| Cpd-1 | | 0.06 |
| HBS-1 | | 0.04 |
| Gelatin | | 0.60 |
| (Low-speed white-sensitive layer-a) | | |
| Silver iodobromide emulsion F | silver | 0.22 |
| Silver iodobromide emulsion G | silver | 0.35 |
| Gelatin | | 0.95 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExM-3 | | 0.45 |
| ExM-4 | | $4.3 \times 10^{-2}$ |
| EXY-5 | | $7.0 \times 10^{-3}$ |
| HBS-1 | | 0.30 |
| HBS-3 | | 0.015 |
| Cpd-4 | | 0.010 |
| (Medium-speed white-sensitive layer-a) | | |
| Silver iodobromide emulsion G | silver | 0.48 |
| Silver iodobromide emulsion H | silver | 0.48 |
| Gelatin | | 0.80 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExM-3 | | 0.115 |
| ExM-4 | | $3.5 \times 10^{-2}$ |
| EXY-5 | | $5.0 \times 10^{-3}$ |
| HBS-1 | | 0.13 |
| HBS-3 | | $4.4 \times 10^{-3}$ |
| Cpd-4 | | 0.011 |
| (High-speed white-sensitive layer-a) | | |
| Silver iodobromide emulsion I | silver | 1.30 |
| Gelatin | | 1.33 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExM-1 | | $1.0 \times 10^{-2}$ |
| ExM-2 | | $3.0 \times 10^{-2}$ |
| ExM-5 | | $7.0 \times 10^{-3}$ |
| ExM-6 | | $5.0 \times 10^{-3}$ |
| EXY-5 | | $2.0 \times 10^{-3}$ |
| HBS-1 | | 0.25 |
| Cpd-4 | | $4.0 \times 10^{-2}$ |

(Preparation of Sample 103)

Sample 103 was prepared following the same procedure as in the preparation of the sample 102 except that the order of the layer formation from the support was the 1st antihalation layer/the 2nd antihalation layer/interlayer-1/low-speed red-sensitive emulsion layer/medium-speed red-sensitive emulsion layer/yellow filter layer/low-speed blue-sensitive emulsion layer/interlayer-3/low-speed white-sensitive layer-b/medium-speed white-sensitive layer-b/interlayer-4/high-speed red-sensitive emulsion layer/interlayer-5/high-speed blue-sensitive emulsion layer/interlayer-6/high-speed white-sensitive layer-a/the 1st protective layer/the 2nd protective layer. The compositions of interlayer-4 to interlayer-6 were entirely the same as that of the interlayer 3. The compositions of low-speed white-sensitive layer-b and medium-speed white-sensitive layer-b are shown below.

| | | |
|---|---|---|
| (Low-speed white-sensitive layer-b) | | |
| Silver iodobromide emulsion G | silver | 0.22 |
| Silver iodobromide emulsion H | silver | 0.35 |
| Gelatin | | 0.95 |
| ExS-1 | | $3.9 \times 10^{-5}$ |
| ExS-2 | | $2.6 \times 10^{-5}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExM-3 | | 0.45 |
| ExM-4 | | $4.3 \times 10^{-2}$ |
| EXY-5 | | $7.0 \times 10^{-3}$ |
| HBS-1 | | 0.30 |
| HBS-3 | | 0.015 |
| Cpd-4 | | 0.010 |
| (Medium-speed white-sensitive layer-b) | | |
| Silver iodobromide emulsion H | silver | 0.48 |
| Silver iodobromide emulsion I | silver | 0.48 |
| Gelatin | | 0.80 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExM-3 | | 0.115 |
| ExM-4 | | $3.5 \times 10^{-2}$ |
| EXY-5 | | $5.0 \times 10^{-3}$ |
| HBS-1 | | 0.13 |
| HBS-3 | | $4.4 \times 10^{-3}$ |
| Cpd-4 | | 0.011 |

(Preparation of Sample 104)

Sample 104 was prepared following the same procedure as in the preparation of the sample 103 except that the a light-reflecting layer-1 was formed in place of the interlayer-5 and a light-reflecting layer-2 was formed in place of the interlayer-6. That is, the order of the layer formation from the support was the 1st antihalation layer/the 2nd antihalation layer/interlayer-1/low-speed red-sensitive emulsion layer/medium-speed red-sensitive emulsion layer/yellow filter layer/low-speed blue-sensitive emulsion layer/interlayer-3/low-speed white-sensitive layer-b/medium-speed white-sensitive layer-b/interlayer-4/high-speed red-sensitive emulsion layer/light-reflecting layer-1/high-speed blue-sensitive emulsion layer/light-reflecting layer-2/high-speed white-sensitive layer-a/the 1st protective layer/the 2nd protective layer. The compositions of the light-reflecting layer-1 and the light-reflecting layer-2 are shown below.

| | | |
|---|---|---|
| (light-reflecting layer-1) | | |
| Silver bromide emulsion O | silver | 0.32 |
| Cpd-1 | | 0.06 |
| HBS-1 | | 0.04 |
| Gelatin | | 0.60 |
| (light-reflecting layer-2) | | |
| Silver bromide emulsion P | silver | 0.32 |
| Cpd-1 | | 0.06 |
| HBS-1 | | 0.04 |
| Gelatin | | 0.60 |

(Preparation of Sample 105)

Sample 105 was prepared following the same procedure as in the preparation of the sample 104 except that the low-speed blue-sensitive emulsion layer and the high-speed blue-sensitive emulsion layer were replaced respectively with the medium-speed green-sensitive emulsion layer and the high-speed green-sensitive emulsion layer prepared for use in the sample 101; the position of the interlayer-3 was replaced with the position of the yellow filter; and the low-speed white-sensitive layer-b, the medium-speed white-sensitive layer-b and the high-speed white-sensitive layer-a were replaced with the low-speed white-sensitive layer-c, the medium-speed white-sensitive layer-c and the high-speed white-sensitive layer-c, respectively, having the compositions shown below. That is, the order of the layer formation from the support was the 1st antihalation layer/the 2nd antihalation layer/interlayer-1/low-speed red-sensitive emulsion layer/medium-speed red-sensitive emulsion layer/interlayer-3//medium-speed green-sensitive emulsion layer/yellow filter layer/low-speed white-sensitive layer-c/medium-speed white-sensitive layer-c/interlayer-4/high-speed red-sensitive emulsion layer/light-reflecting layer-1/high-speed green-sensitive emulsion layer/light-reflecting layer-2/high-speed white-sensitive layer-c/the 1st protective layer/the 2nd protective layer.

| (Low-speed white-sensitive layer-c) | | |
|---|---|---|
| Silver iodobromide emulsion G | silver | 0.22 |
| Silver iodobromide emulsion H | silver | 0.35 |
| Gelatin | | 0.95 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExY-2 | | 0.90 |
| EXY-5 | | $7.0 \times 10^{-3}$ |
| HBS-1 | | 0.30 |
| Cpd-4 | | 0.010 |
| (Medium-speed white-sensitive layer-c) | | |
| Silver iodobromide emulsion H | silver | 0.48 |
| Silver iodobromide emulsion I | silver | 0.48 |
| Gelatin | | 0.80 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExY-2 | | 0.23 |
| EXY-5 | | $5.0 \times 10^{-3}$ |
| HBS-1 | | 0.08 |
| Cpd-4 | | 0.011 |
| (High-speed white-sensitive layer-c) | | |
| Silver iodobromide emulsion I | silver | 1.30 |
| Gelatin | | 1.33 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExY-2 | | 0.11 |
| EXY-5 | | $2.0 \times 10^{-3}$ |
| HBS-1 | | 0.05 |
| Cpd-4 | | $4.0 \times 10^{-2}$ |

(Preparation of Sample 106)

Sample 106 was prepared following the same procedure as in the preparation of the sample 104 except that the low-speed white-sensitive layer-b, the medium-speed white-sensitive layer-b and the high-speed white-sensitive layer-a were replaced with the low-speed white-sensitive layer-a, the medium-speed white-sensitive layer-a and the high-speed white-sensitive layer-d, respectively, having the composition shown below.

| (High-speed white-sensitive layer-d) | | |
|---|---|---|
| Silver iodobromide emulsion H | silver | 1.30 |
| Gelatin | | 1.33 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExM-1 | | $1.0 \times 10^{-2}$ |
| ExM-2 | | $3.0 \times 10^{-2}$ |
| ExM-5 | | $7.0 \times 10^{-3}$ |
| ExM-6 | | $5.0 \times 10^{-3}$ |
| EXY-5 | | $2.0 \times 10^{-3}$ |
| HBS-1 | | 0.25 |
| Cpd-4 | | $4.0 \times 10^{-2}$ |

(Preparation of Sample 107)

Sample 107 was prepared following the same procedure as in the preparation of the sample 102 except that all of the positions of the white-sensitive layers were shifted to the positions nearer to the support than the blue-sensitive emulsion layers and the low-speed white-sensitive layer-a, medium-speed white-sensitive layer-a and the high-speed white-sensitive layer-a were replaced with the low-speed white-sensitive layer-e, the medium-speed white-sensitive layer-e and the high-speed white-sensitive layer-e, respectively, having the compositions shown below. That is, the order of the layer formation from the support was the 1st antihalation layer/the 2nd antihalation layer/interlayer-1/low-speed red-sensitive emulsion layer/medium-speed red-sensitive emulsion layer/high-speed red-sensitive emulsion layer/yellow filter layer/low-speed white-sensitive layer-e/medium-speed white-sensitive layer-e/high-speed white-sensitive layer-e/interlayer-3/low-speed blue-sensitive emulsion layer/high-speed blue-sensitive emulsion layer/the 1st protective layer/the 2nd protective layer.

| (Low-speed white-sensitive layer-e) | | |
|---|---|---|
| Silver iodobromide emulsion F | silver | 0.22 |
| Silver iodobromide emulsion G | silver | 0.35 |
| Gelatin | | 0.95 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExS-9 | | $5.0 \times 10^{-5}$ |
| ExM-3 | | 0.45 |
| ExM-4 | | $4.3 \times 10^{-2}$ |
| EXY-5 | | $7.0 \times 10^{-3}$ |
| HBS-1 | | 0.30 |
| HBS-3 | | 0.015 |
| Cpd-4 | | 0.010 |
| (Medium-speed white-sensitive layer-e) | | |
| Silver iodobromide emulsion G | silver | 0.48 |
| Silver iodobromide emulsion H | silver | 0.48 |
| Gelatin | | 0.80 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExS-9 | | $5.0 \times 10^{-5}$ |
| ExM-3 | | 0.115 |
| ExM-4 | | $3.5 \times 10^{-2}$ |
| EXY-5 | | $5.0 \times 10^{-3}$ |
| HBS-1 | | 0.13 |

-continued

| | | |
|---|---|---|
| HBS-3 | | $4.4 \times 10^{-3}$ |
| Cpd-4 | | 0.011 |
| (High-speed white-sensitive layer-e) | | |
| Silver iodobromide emulsion I | silver | 1.30 |
| Gelatin | | 1.33 |
| ExS-1 | | $3.9 \times 10^{-5}$ |
| ExS-2 | | $2.6 \times 10^{-6}$ |
| ExS-3 | | $7.5 \times 10^{-5}$ |
| ExS-4 | | $2.3 \times 10^{-5}$ |
| ExS-5 | | $5.2 \times 10^{-5}$ |
| ExS-6 | | $2.0 \times 10^{-4}$ |
| ExS-9 | | $5.0 \times 10^{-5}$ |
| ExM-1 | | $1.0 \times 10^{-2}$ |
| ExM-2 | | $3.0 \times 10^{-2}$ |
| ExM-5 | | $7.0 \times 10^{-3}$ |
| ExM-6 | | $5.0 \times 10^{-3}$ |
| EXY-5 | | $2.0 \times 10^{-3}$ |
| HBS-1 | | 0.25 |
| Cpd-4 | | $4.0 \times 10^{-2}$ |

(Preparation of Sample 108)

Sample 108 was prepared following the same procedure as in the preparation of the sample 104 except that ExS-9 was excluded from the low-speed blue-sensitive emulsion layer and from the high-speed blue-sensitive emulsion layer.

(Preparation of Sample 109)

Sample 109 was prepared following the same procedure as in the preparation of the sample 104 except that ExS-1 was excluded from the low-speed red-sensitive emulsion layer, the medium-speed red-sensitive emulsion layer and the high-speed red-sensitive emulsion layer, and ExS-2 was included instead.

(Preparation of Sample 110)

Sample 110 was prepared following the same procedure as in the preparation of the sample 104 except that ExS-9 was excluded from the low-speed white-sensitive layer-b, the medium-speed white-sensitive layer-b and the high-speed white-sensitive layer-a; and the amounts of ExS-1, ExS-2 and ExS-3 were reduced to ⅕ of the respective original amounts and the amounts of ExS-4, ExS-5 and ExS-6 were increased at the same ratio to make up for the decrements.

(Preparation of Sample 111)

Sample 111 was prepared following the same procedure as in the preparation of the sample 104 except that the amounts of ExS-1, ExS-2 and ExS-3 were reduced to ½ of the respective original amounts and the amounts of ExS-4, ExS-5 and ExS-6 were increased at the same ratio to make up for the decrements.

The color negative films for input, i.e., samples 101 to 111, were each made into a roll for 24 exposures of 135 size. The roll was loaded in a single lens reflex camera (Nikon F IV) and was used for photographing a subject consisting of a person and a Macbeth checker chart by varying the aperture scale by ½ in an aperture range of from minus 5 to plus 5 to a standard exposure.

The exposed films were developed by means of an automatic processor FP-360B manufactured by Fuji Film Co., Ltd. The processor FP-360B is provided with the means for compensating for evaporation described in Journal of Technical Disclosure No. 94-4,992 of JIII.

The processing steps and the compositions of the processing solutions are shown below.

(Processing Steps)

| Step | Time | Temperature | Quantity of replenisher* | Tank volume |
|---|---|---|---|---|
| Color development | 3 min. 5 sec. | 38.0° C. | 20 mL | 17 L |
| Bleaching | 50 sec. | 38.0° C. | 5 mL | 5 L |
| Fixing(1) | 50 sec. | 38.0° C. | — | 5 L |
| Fixing(2) | 50 sec. | 38.0° C. | 8 mL | 5 L |
| Water washing | 30 sec. | 38.0° C. | 17 mL | 3.5 L |
| Stabilizing (1) | 20 sec. | 38.0° C. | — | 3 L |
| Stabilizing (2) | 20 sec. | 38.0° C. | 15 mL | 3 L |
| Drying | 1 min. 30 sec. | 60° C. | | |

*Quantity of replenisher means the amount of the replenisher on the basis of the light-sensitive material having a width of 35 mm and a length of 1.1 m (corresponding to a roll of 24 exposures).

The stabilizing solution flowed from (2) to (1) in a counter-current system and all of the overflow of the washing water was introduced into the stabilizing (2) step. The fixing solution was also connected from (2) to (1) in a counter-current piping system. Based on the light-sensitive material having a width of 35 mm and a length of 1.1 m, the amount of carry-over of the developing solution into the bleaching step was 2.5 mL, the amount of carry-over of the bleaching solution into the fixing step was 2.0 mL, and the amount of carry-over of the fixing solution into the water washing step was 2.0 mL. The crossover time was 6 seconds for any of the steps, and this time is included in the processing time of the preceding step.

In the above-mentioned processor, the aperture area was 100 $cm^2$ for the color developing solution, 120 $cm^2$ for the bleaching solution and 100 $cm^2$ for each of other processing solutions.

The compositions of the processing solutions are shown below.

| (Color developing solution) | Tank solution (g) | Replenishment solution (g) |
|---|---|---|
| Diethylenetriaminepentaacetic acid | 2.0 | 2.0 |
| 1-hydroxyethylidene-1,1-diphosphonic acid | 2.0 | 2.0 |
| Sodium sulfite | 3.9 | 5.3 |
| Postassium carbonate | 37.5 | 39.0 |
| Potassium bromide | 1.4 | 0.4 |
| Potassium iodide | 1.3 mg | — |
| Disodium N,N-bis(sulfonateethyl)hydroxylamine | 2.0 | 2.0 |
| Hydroxylamine sulfate | 2.4 | 3.3 |
| 2-methyl-4-(N-ethyl-N-(β-hydroxyethyl)amino)aniline sulfate | 4.5 | 6.4 |
| Water to make | 1.0 L | 1.0 L |
| pH(controlled by potassium hydroxide and sulfuric acid) | 10.05 | 10.18 |

| (Bleaching solution) | Tank solution (g) | Replenishment solution (g) |
|---|---|---|
| Ferric ammonium 1,3-diaminopropanetetraacetate monohydrate | 118 | 180 |
| Ammonium bromide | 80 | 115 |
| Ammonium nitrate | 14 | 21 |

-continued

| (Bleaching solution) | Tank solution (g) | Replenishment solution (g) |
|---|---|---|
| Succinic acid | 40 | 60 |
| Maleic acid | 33 | 50 |
| Water to make | 1.0 L | 1.0 L |
| pH(controlled by ammonia water) | 4.4 | 4.0 |

| (Fixing solution) | Tank solution (g) | Replenishment solution (g) |
|---|---|---|
| Ammonium methanesulfinate | 10 | 30 |
| Ammonium methanethiosulfonate | 4 | 12 |
| Aqueous thiosulfate ammonium solution(700 g/L) | 280 mL | 840 mL |
| Imidazole | 7 | 20 |
| Ethylenediaminetetraacetic acid | 15 | 45 |
| Water to make | 1.0 L | 1.0 L |
| pH(controlled by ammonia water and acetic acid) | 7.4 | 7.45 |

(Washing Water)

Tap water was supplied to a mixed-bed column filled with an H-type strongly acidic cation exchange resin (Amberlite IR-120B: available from Rohm & Haas Co.) and an OH-type strongly basic anion exchange resin (Amberlite IR-400) to set the concentrations of calcium and magnesium to be 3 mg/L or less. Subsequently, 20 mg/L of sodium isocyanuric acid dichoro and 150 mg/L of sodium sulfate were added. The pH of the solution ranged from 6.5 to 7.5.

| (Stabilizer) Common to tank solution and replenishment solution (g) | |
|---|---|
| Sodium p-toluenesulfinate | 0.03 |
| Polyoxyethylene p-monononylphenyl ether (average) polymerization degree: 10) | 0.2 |

-continued

| (Stabilizer) Common to tank solution and replenishment solution (g) | |
|---|---|
| Disodium ethylenediaminetetraacetate | 0.05 |
| 1,2,4-triazole | 1.3 |
| 1,4-bis(1,2,4-triazole-1-ylmehtyl)piperazine | 0.75 |
| 1,2-benziosothiazoline-3-on | 0.10 |
| Water to make | 1.0 L |
| pH | 8.5 |

After being processed in the above-described procedures, the negative film underwent the image processing by means of the apparatus shown in FIG. 1 and the resultant output was formed on Fuji Color Laser Paper. In the image processing, the algorithm was performed according to the method shown in FIG. 3.

The output image was shown to randomly selected 10 examiners for visual evaluation.

Five ratings were set to the evaluation of allowable limit aperture on underexposure side and to the levels of graininess at a standard exposure amount. The average points obtained from the ten examiners were used as values for these items of evaluation. The results are shown in Table 2. In the table 2, the effective sensitivity having a larger number in minus is better, and the grain coarseness having a smaller number exhibits a better result due to finer grains.

TABLE 2

| Sample No. | | S450/S550 | S600/S550 | λ Bmax | λ Gmax | λ Rmax | Effective sensitivity (diaphragm) | Grain coarseness |
|---|---|---|---|---|---|---|---|---|
| 101 | (Comparative example) | (0.04) | (0.02) | 470 | 551 | 645 | −2.2 | 3.7 |
| 102 | (Present invention) | 0.52 | 0.87 | 471 | — | 646 | −2.8 | 3.1 |
| 103 | (Present invention) | 0.53 | 0.89 | 470 | — | 644 | −3.2 | 3.0 |
| 104 | (Present invention) | 0.50 | 0.85 | 468 | — | 644 | −3.8 | 3.3 |
| 105 | (Present invention) | 0.50 | 0.85 | — | 557 | 643 | −3.6 | 3.1 |
| 106 | (Present invention) | 0.50 | 0.86 | 469 | — | 645 | −3.0 | 2.3 |
| 107 | (Present invention) | 0.55 | 0.65 | 471 | — | 645 | −2.6 | 3.2 |
| 108 | (Present invention) | 0.52 | 0.83 | 400 | — | 642 | −2.4 | 3.4 |
| 109 | (Present invention) | 0.50 | 0.85 | 470 | — | 671 | −3.7 | 3.6 |
| 110 | (Present invention) | 0.10 | 0.15 | 473 | — | 640 | −2.9 | 3.3 |
| 111 | (Comparative example) | 1.34 | 1.22 | 469 | — | 647 | −3.8 | 3.7 |

From Table 2, the following becomes apparent.

The sample 101 has no white-sensitive unit and is a so-called conventional light-sensitive material having blue-sensitive, green-sensitive and red-sensitive units. If the green-sensitive unit is regarded as a white-sensitive unit, the values of $S_{450}/S_{550}$ and $S_{600}/S_{550}$ are each 0.05 or less. The samples 102 to 110, which have a white-sensitive unit and the values of $S_{450}/S_{550}$ and $S_{600}/S_{550}$ each equal to 0.05 or more, are superior to the sample 101 both in effective sensitivity and in grain coarseness (graininess) on print. It should be pointed out, however, that the sensitivity only slightly increases in the case of the sample 110 whose values of $S_{450}/S_{550}$ and $S_{600}/S_{550}$ are each 1.2 or less. In the case of the sample 111, whose values of $S_{450}/S_{550}$ and $S_{600}/S_{550}$ are each too large and are 1.2 or more, the grain coarseness increases, although the effective sensitivity is high.

Both of the sensitivity and the grain coarseness are of desirable levels in the case of the sample 103 in which the light-sensitive layers are arranged from the farthest from the support in the order of a high-speed white-sensitive layer, a high-speed blue-sensitive layer and a high-speed red-sensitive layer.

A desirable result with a particularly increased sensitivity is obtained in the case of the sample 104 in which a reflecting layer is formed in the position adjacent to a high-speed white-sensitive layer and in the position adjacent to a high-speed blue-sensitive layer.

If the sensitivity is sufficiently high, the grain coarseness can be desirably reduced by reducing the grain size of the silver halide emulsion to be used in the white-sensitive unit as in the case of the sample 105.

Meanwhile, the increase in the effective sensitivity is insufficient, if λ Bmax, which is a spectral sensitivity of a light-sensitive unit other than the white-sensitive unit, is a short wave and is 400 nm as in the case of the sample 108.

Further, the grain coarseness due to color correction increases significantly, although the sensitivity is sufficiently high, if λ Rmax is a long wave and is 671 nm as in the case of the sample 109. In this case, the color appearance, in which the purple color took on a tint of red and which could not be corrected by the digital image processing, was observed.

Both of the sharpness and the color reproduction, which depend largely on the algorithm of the image processing, were satisfactory in this example.

Example 2

The color negative film samples 101 to 107 prepared in Example 1 for input were cut into a shape of advanced photo system, i.e., a 24 mm-wide and 160 cm-long shape. Further, a set of 2 mm-square perforations with a spacing of 5.8 mm were formed on one side at 0.7 mm from end of width in the longitudinal direction, and this set of perforations was repeated at an interval of 32 mm. The thus obtained cut samples were accommodated in plastic cartridges illustrated in FIGS. 1 to 7 of U.S. Pat. No. 5,296,887.

The cartridges housing the samples were loaded in the film units with lens illustrated in FIG. 2 of European Patent 723,180A.

These another films with lens having no stroboscope were used for photographing various subjects with different levels of brightness, and were then subjected to evaluation as in Example 1. The results were nearly the same as in Example 1 in terms of effective sensitivity and grain coarseness.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A silver halide color photographic light-sensitive material comprising a support having provided thereon three light-sensitive units each having a different color-sensitivity, wherein one of said light-sensitive units is a white-sensitive unit having the spectral sensitivity distribution satisfying the following conditions:

$0.05 \leqq S_{450}/S_{550} \leqq 1.2$ and $0.05 \leqq S_{600}/S_{550} \leqq 1.2$ wherein $S_{450}$, $S_{550}$ and $S_{600}$ represent sensitivities at 450 nm, 550 nm, and 600 nm respectively;

wherein the light-sensitive units other than said white-sensitive unit are two light-sensitive units selected from the group consisting of a blue-sensitive unit, a green-sensitive unit and a red-sensitive unit having the following wavelengths for maximum spectral sensitivity, respectively:

$410 \leqq \lambda$ Bmax $\leqq 490$ nm $510 \leqq \lambda$ Gmax $\leqq 590$ nm $580 \leqq \lambda$ Rmax $\leqq 660$ nm wherein λ B max, λ Gmax and λ Rmax represent the wavelengths for maximum spectral sensitivity of the blue-sensitive unit, the green-sensitive unit and the red-sensitive unit, respectively; and wherein a non light-sensitive intermediate layer containing substantially non light-sensitive silver halide grains is formed in a position adjacent to the high-speed white-sensitive layer and/or the high-speed light-sensitive layer of the light-sensitive units other than the white-sensitive unit on the side of these layers facing toward the support.

2. The silver halide color photographic light-sensitive material according to claim 1, wherein at least one layer of the white-sensitive unit is formed in a position farthest from the support among all of the light-sensitive silver halide emulsion layers.

3. The silver halide color photographic light-sensitive material according to claim 1, wherein a non light-sensitive intermediate layer containing substantially non light-sensitive silver halide grains is formed in a position adjacent to the high-speed white-sensitive layer and/or the high-speed light-sensitive layer of the light-sensitive units other than the white-sensitive unit on the side of these layers facing toward the support.

4. The silver halide color photographic light-sensitive material according to claim 2, wherein a non light-sensitive intermediate layer containing substantially non light-sensitive silver halide grains is formed in a position adjacent to the high-speed white-sensitive layer and/or the high-speed light-sensitive layer of the light-sensitive units other than the white-sensitive unit on the side of these layers facing toward the support.

5. The silver halide color photographic light-sensitive material according to claim 1, wherein the spectral sensitivity distribution of the white-sensitive unit and the spectral sensitivity distributions of other two light-sensitive units, each give 0.7 or more of the value for calorimetric quality factor.

6. The silver halide color photographic light-sensitive material according to claim 1, wherein the order of the layer formation from the position farthest from the support is a white-sensitive unit having the highest sensitivity, a second color-sensitive layer having the highest sensitivity, a third color-sensitive layer having the highest sensitivity, a white-sensitive unit having the second highest sensitivity, a second color-sensitive layer having the second highest sensitivity and a third color-sensitive layer having the second highest sensitivity, when every light-sensitive unit consist of two or more light-sensitive layers each having a different sensitivity.

7. A method for forming images using the silver halide color photographic light-sensitive material according to claim 1, in which said material is imagewise-exposed and subjected to processing, thereby forming an image, the image is read out by an image pick-up means, then subjected to digital image processing, and three or more color output signals are obtained.

8. A method for forming images using the silver halide color photographic light-sensitive material according to claim 2, in which said material is imagewise-exposed and subjected to processing, thereby forming an image, the image is read out by an image pick-up means, then subjected to digital image processing, and three or more color output signals are obtained.

9. A method for forming images using the silver halide color photographic light-sensitive material according to claim 3, in which said material is imagewise-exposed and subjected to processing, thereby forming an image, the image is read out by an image pick-up means, then subjected to digital image processing, and three or more color output signals are obtained.

10. The method for forming images according to claim 7, wherein said image pick-up means use an area-type CCD sensor as a sensor.

11. The silver halide color photographic light-sensitive material according to claim 1, wherein the silver halide grains are fine silver halide grains.

12. The silver halide color photographic light-sensitive material according to claim 1, wherein the silver halide grains are tabular silver halide grains having an aspect ratio of 3 or more.

* * * * *